United States Patent [19]

Zabel

[11] 4,092,895

[45] June 6, 1978

[54] ELECTRONIC PIPE ORGAN CONTROL SYSTEM

[76] Inventor: William P. Zabel, 8118 N. Sakaden Pkwy., Fort Wayne, Ind. 46825

[21] Appl. No.: 747,536

[22] Filed: Dec. 6, 1976

[51] Int. Cl.[2] ..... G10B 3/10

[52] U.S. Cl. ..... 84/345; 84/337; 84/341

[58] Field of Search ..... 84/1.01, 1.03, 1.17, 84/337–339, 341, 343–345

[56] References Cited

U.S. PATENT DOCUMENTS

| | | | |
|---|---|---|---|
| 3,160,051 | 12/1964 | Guenther | 84/337 |
| 3,501,990 | 3/1970 | Jappe et al. | 84/337 |

*Primary Examiner*—Edith S. Jackmon
*Attorney, Agent, or Firm*—Ronald D. Welch

[57] ABSTRACT

A solid state electronic relay system for a pipe organ having at least one input register connected to one or more organ manuals, respectively, to receive parallel input signals therefrom, and respectively convert same into a time based serial digital signal wherein each note of the keyboard occupies a particular interval of time in the digital signal. The serialized signal of an input register propagates through a digital delay line at a predetermined clock frequency. Selected ones of the delayed digital signals provided thereby are tapped to derive octave and mutation pitch signals. Accessory circuits receive the serialized digital signals and using combinational and sequential digital techniques modify the digital signals to provide reiteration, pizzicato, sostenuto and the like effects. The tapped signals and modified signals are selectively combined with logical gates under the control of the organ "stops" to provide the unification and accessory functions. The combined digital signals are routed to control specified organ pipes through a plurality of rank drivers which receive the serialized signals and produce a plurality of periodically updated parallel signals therefrom to effect sound reproduction in response to the signals generated by the organ manuals, stop keys, and accessory circuits.

40 Claims, 14 Drawing Figures

Fig. 2
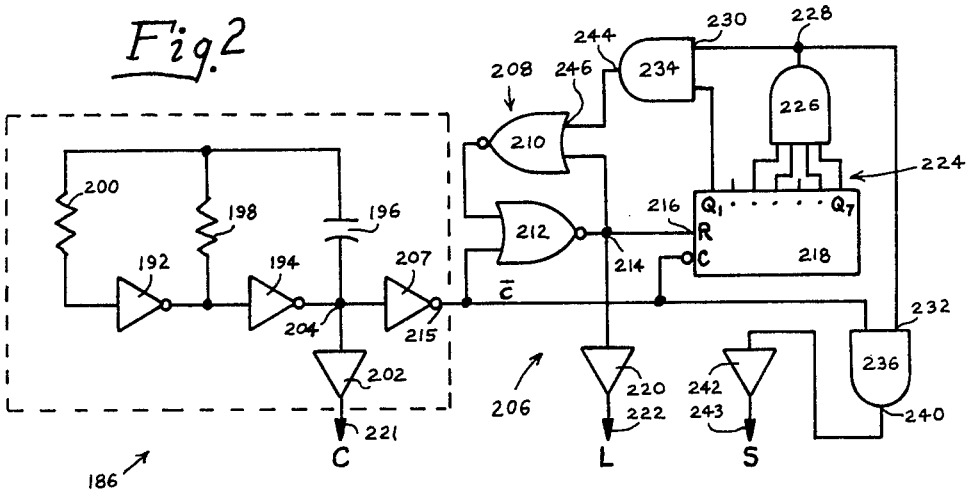
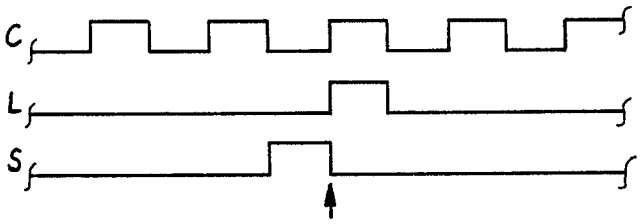
Fig. 3
Fig. 4
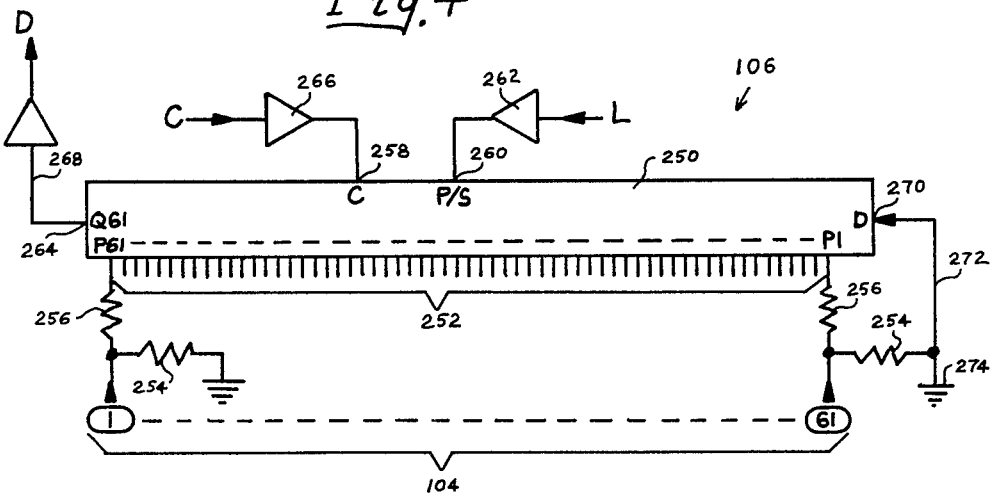

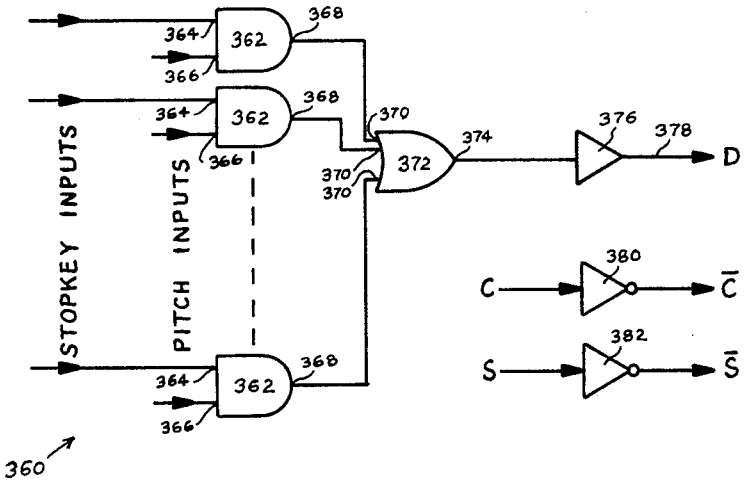
Fig. 6
Fig. 7
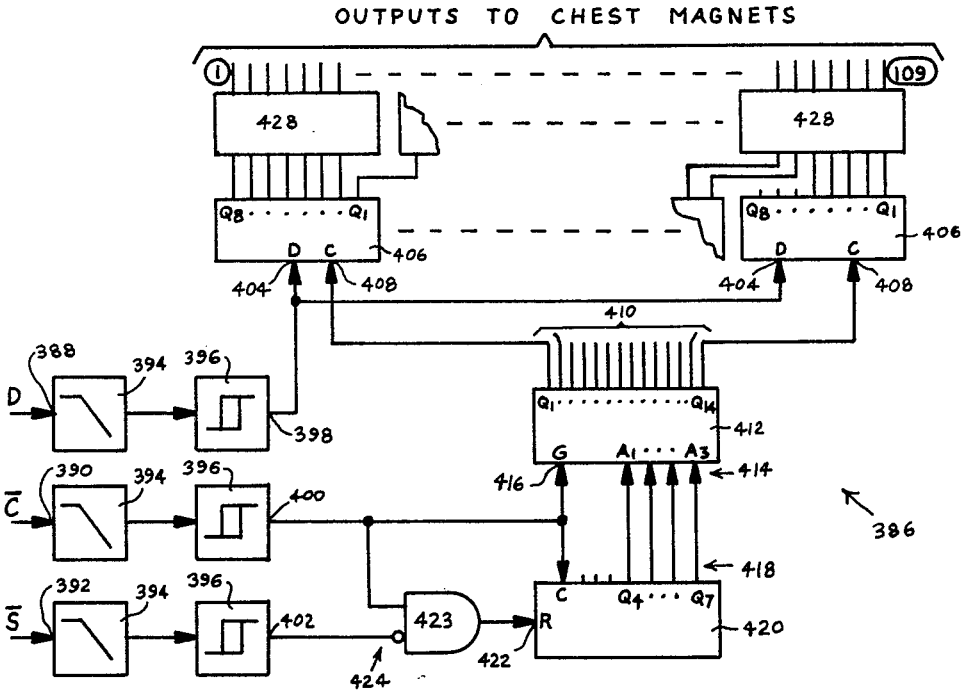

ELECTRONIC PIPE ORGAN CONTROL SYSTEM

BACKGROUND OF THE INVENTION

1. Field of the Invention

The present invention relates to pipe organs and in particular to a solid state, electronic relay or control system for use in such a pipe organ.

2. Description of the Prior Art

The pipe organ in its earliest and simplest forms consisted of a single group or "rank" of pneumatically activated pipes with individual ones of the pipes being operated by a single key of a keyboard or "manual". The individual pipes were coupled to a plenum or "wind chest" through a valve, individual ones of the valves being coupled mechanically to particular individual ones of the manual keys. As the musical demands on pipe organs grew, additional ranks of pipes and additional manuals were continuously added to the basic pipe organ. Each individual pipe of the organ was still, however, operated exclusively by a single key of the manual. This type of organ is referred to as a "tracker" organ.

The next significant development in the organ was the addition of the stop key, or simply, "stop", which enabled operation of more than one rank of pipes from each key of a manual. By selectively engaging one or more of the stops, a single key would energize one or more pipes, each in a different rank.

Various schemes evolved for playing more and more ranks of pipes from a single manual and to permit some degree of flexibility in the location of the manuals with respect to the organ pipes. All such organ architectures had one feature in common, however, in that any particular pipe could be played only from a single key of a single manual via a single stop. Thus, if it was desired to add an additional musical pitch or "voice" which could be activated or sounded from a certain manual, it was necessary to add an entire rank of additional pipes which were in turn connected to the manual via a stop.

Subsequently, the concept of a coupler was added to the pipe organ, the coupler being an additional control resembling a stop but which enabled operation of a particular group of ranks from a manual other than the manual with which the group was primarily associated or, in the alternative, to enable operation of the group from one or more additional keys of the same manual. These couplers were referred to as inter-manual and intra-manual couplers, respectively. This system did not, however, permit coupling of an individual stop activated rank to a different manual or different keys of the same manual individually, but rather required that all of the groups activated or "registered" for the particular manual by a stop were operationally coupled as a group.

Subsequently, the electro-pneumatic pipe organ was developed to eliminate the cumbersome pneumatic coupling and mechanical coupling mechanisms. In this development, the various bellows and pneumatic tubes connecting the various components were replaced with magnetic valves or "chest magnets" and the pneumatic tubes or linkages were replaced by electrical conductors. In the course of this development, it was realized that the then existing concept of one note, one stop, one pipe, represented an inefficient use of the organ pipes and that the coupler approach to expanding the versatility of the organ was still unnecessarily restrictive. For example, if an organ was equipped with a rank of pipes with the sound or "voice" of a flute and wherein the lowest pitch pipe was an 8 foot pipe, and it was desired to add a rank of pipes also having the sound or voice of a flute but with the lowest pitch being a 4 foot pipe, it is necessary in a classical organ, to add an entire sixty-one rank of pipes having a 4 foot pipe as the lowest pitch pipe in the rank. Ultimately, this led to the concept of "unification".

In its simplest terms, unification is the technique of expanding or extending pipes having a particular "voice" such that it, (the extended rank) can be used as if it were in fact two or more ranks of the same voice. For example, if a organ includes an 8 foot flute "voiced" rank of pipes, and it is desired to add a 4 foot flute voiced rank of pipes, it is only necessary to extend the treble end of the 8 foot rank by twelve (one octave) additional pipes. The rank now comprises 73 pipes instead of 61 and includes all of the pipes necessary for both an 8 foot and a 4 foot rank of flute voiced pipes. By operatively connecting the 61 lower (in pitch) pipes to a 61 key manual, and/or the 61 higher (in pitch) pipes to the manual, the organ is provided with substantially the same versatility as would be achieved by providing it with two separate 61 flute voiced ranks.

To effect such a system, each key of a manual is used to operate an electrical switch which in turn operates a note relay. Each of the note relays distributes control voltage to a plurality of secondary contacts and simultaneously establishes control isolation between the contacts when the note key is idle. A stop is derived by cabling a single contact from each note relay of a manual to a "stack switch" which is simply a 61 pole single throw switch operated from a stop switch of the console. The secondary contacts of the stack switches are connected to a multi-wire buss, the buss also being connected to the secondary contacts of other stack switches. The secondary contact buss is routed to the chest magnets controlling the pipes of a certain rank.

Thus configured, the relay system comprised an elaborate switching matrix. Thus, using the same example, if an organ has an 8 foot stop of a particularly voiced rank and it is decided to add a 4 foot stop of the same voice which can be operated from the same manual as the 8 foot rank, it is not necessary to install an entire additional rank as the case with classical organs. Rather, it is only necessary to extend the treble end of the existing 8 foot rank by 12 pipes, extend the treble end of the secondary switch buss by 12 wires, and install another key switch electrically displaced 12 wires from the first one. This results in a system having a high degree of musical versatility.

Further developments in the art have been directed to improvement of the basic "unification" concept and have included efforts to combine switches and to adapt solid state electronic technology to the switching operations to eliminate mechanical contacts and the like. Nonetheless, present pipe organs still incorporate the traditional parallel-processing of signals from the manual keys to the organ pipes. Thus, in a typical installation which might include four manual keyboards and more than a dozen ranks of organ pipes, the number of connections that must be routed from the manual to the pipes is extremely great. Further, consideration of the number of individual connections that must be made to route these signals from key switches through stack switches, couplers, stops, chest magnets, etc., renders even modern day versions of such a system extremely cumbersome and difficult to install and maintain. Additionally, the cost of such an installation and the time required for same is high and often prohibitive. Each organ also tends to be a "custom" installation and changes in the organ configuration are difficult at best.

Some recent efforts have been made to produce a control system which incorporates the concept of multiplexing whereby the number of wires interconnected between the manuals and the organ pipes is substantially reduced. However, even in these systems, the concept of unification has received little if any attention inasmuch as most of these installations are applied to classical or liturgical type organs where unification is not generally utilized. Thus, the ultimate goal of unification, -increased versatility of the organ-, remains to be improved. Further, the accessory functions such as pizzicato, reiteration, and sostenuto must be retained to provide an organ having full musical capacity.

SUMMARY OF THE INVENTION

Broadly, the present invention is a relay system for use in a pipe organ, the organ including at least one manual and at least one rank of organ pipes individually operable via chest magnets. The relay system includes input register means having a plurality of input terminals for receiving parallel input data from a manual keyboard and converting the parallel data into a serial data train under the control of clock signals received from a master oscillator circuit. The serial data train will include one data bit for each key of an organ manual and the data bits occur in a time based sequence corresponding directly to the chromatic sequence of the keys of the manual, whereby, the time relationship of the bits in the serial data signal corresponds with the chromatic spacial relationship of the manual keys. The organ pipes are in turn driven by a rank driver circuit which is connected to receive the chromatic time based signals originating from the input registers to generate periodically updated parallel signals corresponding to the manual data inputted by the keyboard, thereby causing corresponding ones of the organ pipes to speak.

Typically, the organ will include a plurality of manuals, a plurality of ranks of organ pipes, and a plurality of coupler tabs for selectively coupling selected manuals and keys of selected manuals to the different groups of ranks of organ pipes. To this end, the relay of the present invention further includes a plurality of pitch registers having inputs connected to receive the chromatic, time based serial data signals from the input registers and signals from the coupler tabs. Included within the pitch registers are a plurality of logical gates and a digital delay line responsive to selective operation of the coupler tabs for additively injecting the serial data signals from the input registers into the delay line at various points and a plurality of pitch output means, each such pitch output being derived from a different stage of the delay line for providing a corresponding plurality of delayed serial data signals wherein selected ones of the data bits thereof, generated by manual manipulation of a particular manual key, will generate signals transposed or delayed in time by varying numbers of clock cycles. This ability to inject selected signals and logical combinations thereof into the delay line permits intra-manual and inter-manual coupling of the organ keys.

Selective recombination of the delayed signals by rank-stop combiners facilitates unification of the organ. These rank-stop combiners, which include a plurality of logic gates, are coupled to receive predetermined serial data signals from the pitch output means of the pitch registers and have a plurality of input terminals connected to receive signals from a plurality of console stop tabs. A specific combiner responds to the signals of the console stop tabs to additively combine and transmit to rank drivers modified serial data signals from different ones of the pitch register pitch output means to thereby activate the various organ pipes within a specific rank or the various notes of a specific tuned percussion.

Trap line circuitry is also provided, this circuitry being connected between a selected manual or manuals and trap selection and controlling means. The trap line circuitry includes logic elements and responds substantially instantaneously to depression or attach and release of the manual keys to generate static signals for the period that a key is depressed, these static signals being applied via the trap controlling means to non-tuned percussion devices to effect sounding thereof.

In addition to the basic serial digital relay system, the relay of the present invention may include a sostenuto control circuit coupled to receive the serial data train from an input register. The sostenuto control includes circuitry responsive to manual manipulation of a sostenuto control switch for receiving and periodically repeating an established sequence of data bits in subsequent data trains for the period for which the sostenuto switch is maintained depressed to provide sustained speaking of selected organ pipes until the sostenuto switch is released.

The relay of the present invention may further include reiteration circuit means coupled to receive data signals from the pitch register outputs and periodically interrupt the transmission of predetermined selected ones of the serial data bits thereof to produce an interrupted sounding of a tuned percussion device, or groups or organ pipes.

The relay of the present invention may also include a pizzicato circuit coupled to receive selected serial data signals and responsive to activation of pizzicato coupler tabs to terminate the transmission of selected data bits of a serial data signal after a predetermined number thereof have occurred successively to provide a pizzicato sounding of selected organ pipes.

The relay of the present invention may further include a plurality of mutation pitch couplers for logically shifting selected ones of the data bits of a serial data train to different chromatic time positions therein, the shifting being effected by digital delay counting techniques to provide selected shifts in the data position in other than octave intervals to provide mutation pitch shifting of the signals.

The relay of the present invention further includes means for serially transmitting data generated by the swell shoes, trem tabs, and toe pistons associated with the organ console and the like.

The relay of the present invention may also be provided with visual effects circuitry responsive to serial signals transmitted from specific rank stop combiners. This circuitry selectively energizes illuminating means positioned adjacent to predetermined ones of the ranks of organ pipes, tuned percussion, and the like of the organ to illuminate same in response to the same signals which energize the respective notes being played on that rank, etc. Preferably, the illuminating circuitry includes time delay means for maintaining energization of the illuminating means for a predetermined period of time during which no note signals are transmitted, and following which, if still no note signals are transmitted, resetting the timing period.

In another specific embodiment of the invention, the rank driver means includes a plurality of serial input-parallel output registers each connected to receive the serial data signals. These registers are individually and sequentially updated at different predetermined time periods corresponding to different predetermined groups of the data bits of the serial data signals transmitted from a correspondingly connected rank-stop combiner. This circuitry permits updating of individual ones of the registers during a fractional portion of the periodic serial data signal transmission, thus providing a substantially static output signal corresponding to the manual input at the organ manuals as modified by the coupler and combiner control means.

It is therefore an object of the invention to provide an improved relay system for use in a pipe organ.

Another object of the invention is to provide such a relay system that uses serial data multiplexing techniques to convert the parallel data of an organ manual into a serial data train.

Still another object of the invention is to provide such a relay using serial data multiplexing techniques to substantially reduce the number of wires required to transmit data from an organ console of ranks of organ pipes.

Another object of the invention is to provide such a relay system which utilizes digital counters, shift registers, and logical gates operating on a time based serial data signal to provide inter-manual coupling and intra-manual coupling.

Still another object of the invention is to provide such a relay system which performs time based organ functions such as pizzicato, sostenuto, and reiteration functions by time based digital manipulation of a serialized, time based serial data train.

Yet another object of the invention is to provide such a relay system which simplifies unification of an organ and substantially reduces the number of electrical conductors and interconnections otherwise required to implement this function.

Another object of the invention is to provide a relay system incorporating substantially all solid state electronic components.

Yet another object of the invention is to provide such a relay system adaptable to a wide variety of organ configurations without requiring tedious hand wiring and modification of the relay system circuitry.

Yet another object of the invention is to provide such a relay system having an output rank driver circuit which incorporates a plurality of sequentially and periodically updated serial input-parallel output registers to provide periodic but musically imperceptible updating of the output signals thereof without the additional expense of latching registers.

Still another object of the invention is to provide such a relay system which utilizes digital logic elements for effecting the coupling and unification functions of a pipe organ.

Another object of the invention is to provide such a relay system operated at a frequency high enough to provide periodic but musicially imperceptible digital control of the sound-producing means of the organ.

Still another object of the invention is to provide such a relay system operating at a frequency low enough to not require elaborate filtering, shielding, and driving circuitry.

Still another object of the invention is to provide such a relay system operating at a frequency in the audio range, thus precluding the need for elaborate test equipment for signal analysis during servicing.

Another object of the invention is to provide such a relay system which simplifies installation, signal tracing, and tuning of the organ.

Yet another object of the invention is to provide such a relay system to which may temporarily be added circuitry enabling a single technician to tune the organ.

Another object of the invention is to provide such a relay system which includes novel circuitry for producing visual effects.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings wherein:

FIG. 2 is a circuit diagram of a master oscillator for use in the present invention;

FIG. 3 is a chart showing the time relationship of signals generated by the master oscillator of FIG. 2;

FIG. 4 is a circuit diagram illustrating the configuration of an input register of the present invention;

FIG. 6 is a logic diagram illustrating the operation of the rank-stop combiner circuitry of the present invention;

FIG. 7 is a circuit diagram illustrating the configuration of a rank driver of the present invention;

DESCRIPTION OF A SPECIFIC EMBODIMENT

Figure 1:
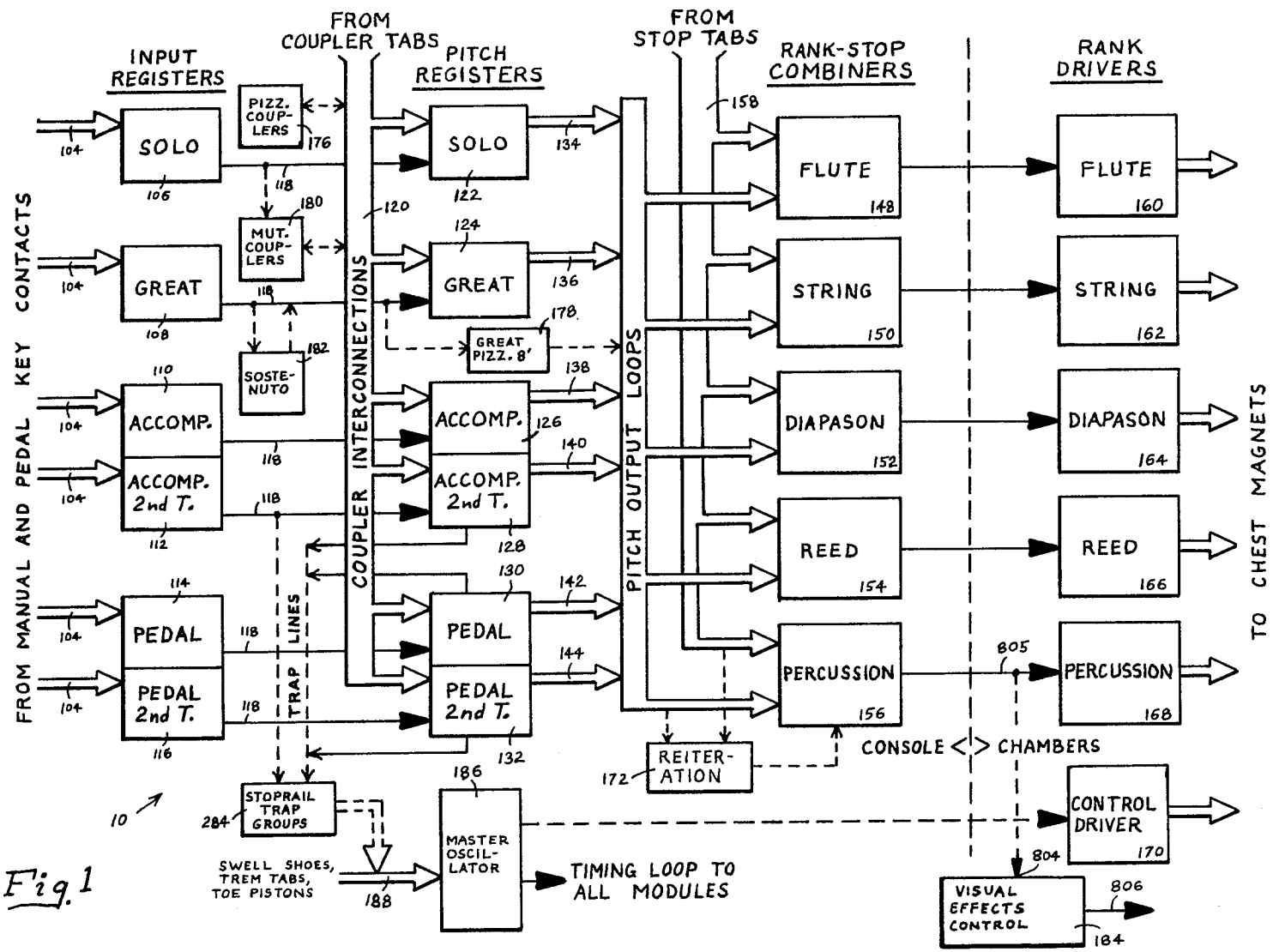
FIG. 1 is a simplified block diagram of a relay system of the present invention.

In the drawings, it should be noted that many of the combinational logic gates (AND gates, OR gates etc.,) are depicted as non-inverting for clarity of illustration. In practice, however, it is convenient and practical to implement most of the logic functions through the use of inverting gates thereby resulting in negative-logic signals appearing at various places throughout the system. The set-reset flip-flops depicted may be implemented with cross-coupled gates and toggle flip-flops or with "J-K" flip-flops. Flip-flops shown as sequential elements typically include "set" and "reset" inputs which inputs have priority over the "clock", "data", and "toggle" inputs thereof. These set and reset inputs respond to a logic "1", and simultaneous stimulous of both these inputs causes a logic 1 to appear at both the "Q" and "$\overline{Q}$" output terminals. While this particular combination of input signals is normally avoided in logic circuits as being an invalid combination, this response is occassionally utilized in some of the following circuit modules when advantageous. All sequential logic elements are edge-triggered, responding to a signal transition from a logic 0 to a logic 1 applied to the clock terminal, unless an inversion symbol is shown at the clock input in which case these elements are edge-triggered by a logic transition from logic 1 to logic 0.

Referring now to the drawings, there is shown in FIG. 1 a simplified block diagram of the electronic control system of the present invention. The system, shown generally at 10, is illustrated for a pipe organ which includes three manual keyboards denoted as "solo", "great", and "accompaniment", a four rank family of organ pipes, one set of tuned percussion, "second touch" on the accompaniment manual, a pedal "keyboard", and "second touch" on the pedal keyboard. The manuals and organ pipes etc. (not shown) comprise the conventional manual keyboards of a pipe organ and conventional ranks of organ pipes and tuned percussion (i.e. xylophone, marimba, etc.). All input signals from the manual keyboards and pedals are generated by simple, normally open switches directly, mechanically connected to the keys and pedals. A typical keyboard will include 61 or 32 notes. At any particular instant, the input of the system 10 from the keyboard and pedals (not shown) comprise a plurality of simultaneously occurring signals which are inputted in parallel, via a multiplicity of conductors grouped into input busses 104, into respective ones of a group of input registers, denoted as "solo" input register 106, "great" input register 108, "accompaniment" input register 110, "accompaniment-second touch" input register 112, "pedal" register 114, and "pedal-second touch" register 116. Each of busses 104 will include as many conductors as there are keys or pedals in the associated manual. For example, the solo keyboard will typically include 61 individual keys and there will be 61 individual conductors in the buss 104 connected in parallel to solo input register 106.

The input registers 106, 108, 110, 112, 114, and 116 include circuitry, to be described below, for converting the parallel input signals from busses 104 into serial output signals which are periodically transmitted by conductors 118, and routed under selective control of a plurality of coupler means denoted generally as "coupler interconnections" 120 through a corresponding plurality of pitch registers 122, 124, 126, 128, 130, and 132, pitch registers 122 through 132 again being denoted as the "solo", "great", "accompaniment", "accompaniment-second touch", "pedal", and "pedal-second touch" pitch registers, respectively. The primary function of the pitch registers 122 through 132, is to produce a plurality of serial output signals which appear on output conductor busses 134, 136, 138, 140, 142, and 144. As will be explained in detail below, signals appearing within each of the busses 134 through 144, each contain the same digital information as the serial input signals from the input registers 106 through 116 as modified by the coupler means such that the output signals are delayed in time by predetermined different numbers of clock cycles. As will be explained below, this time relationship of the digital signals is correlated to the special and chromatic relationship of different musical notes. It is this characteristic that is utilized in the present invention, the conversion of one of the parameters of three dimensional relay matrix to time, that effects significant improvement in the versatility of the manner in which a pipe organ may be structured.

The outputs from the pitch registers 122 through 132 are outputted via conductor groups 134 through 144 in "loop" fashion as will be explained in detail below, to a plurality of rank-stop combiners 148, 150, 152, 154, and 156, these rank-stop combiners being denoted as "Flute", "String", "Diapason", "Reed", and "Percussion", respectively. In the rank-stop combiners, one or more pitch outputs from one or more of the pitch registers 122 through 132 are logically combined under the selective control of signals inputted to the rank-stop combiners 148 through 156 via a plurality of conductors 158 connected to the stop tabs (not shown) of the organ console. Thus, each combiner will output, on a per-rank basis, a composite serial data signal programmed by stop key switches wherein the potential origin of each output is a selected plurality of manual keyboards at a selected plurality of pitches. This composite serial data signal is then transmitted from each combiner 148 through 156 to a corresponding rank driver 160, 162, 164, 166, and 168, denoted in the present example as "Flute", "String", "Diapason", "Reed", and "Percussion", respectively. The rank drivers 160 through 168 receive the serialized data from the rank-stop combiners 148 through 156, reconvert the serialized data into parallel signal groups. The rank drivers 160 through 168 further provide circuitry for generating, in response to said parallel signals, relatively static signals of adequate electrical strength to operate conventional pipe organ chest magnets.

Also shown in FIG. 1 are various accessory circuits that are incorporated into the system 10. These include reiteration module 172, pizzicato couplers 176, 178, mutation couplers 180, sostenuto circuit 182, a "visual effects" circuit 184, and a miscellaneous item control driver 170. Other items such as the stop rail trap groups, swell shoes, trem tabs, and toe position signals are passed through to the miscellaneous driver 170 via conductors 188 (input) and 190 (output).

In overview, the relay of the present invention utilized input registers to convert substantially simultaneously occurring parallel signals generated by a manual keyboard into a binary serial data signal. The serialized data signal itself will be a repetitive signal comprising periodic groups of 61 or 32 sequentially occurring data bits with the value of each data bit being either a logic 1 or a logic 0. Each of the data bits of the signal in turn corresponds to a particular, predetermined one of the notes or keys of the manual or pedal keyboard associated therewith. A logic 1 state will denote a key that is depressed or is otherwise to be sounded and a logic 0 corresponds to a note or key that is idle. Thus, by assigning each of the pulses of the serial data signal to a particular key, in chromatic sequence and digitally advancing or retarding the position of the signals in a particular serial data signal, the serial data signal can be modified to simulate operation of keys that have not been operated and to enable particular operated keys to operate particular organ pipes normally associated with the other keys. Further manipulation of data on a time basis is utilized to effect such functions as a pizzicato, sostenuto, and reiteration these effects being effected by simple counting of data pulses, repeating of data pulses, and interruption thereof as required. Similarly, mutation pitch coupling can be effected by digital counting techniques which in turn can shift the position of signals in a particular serial data signal. It is this basic premise, the conversion of the spacial chromatic relationship of the manual keys to a time based chromatic data signal, and the time based transposition and combination of the data bits thereof in response to logic conditions established by coupler and stop tabs of the organ console that lends versatility and simplicity to the present system for such purposes as coupling, combining, and unification. It is the further use of a serial data signal having a predetermined time base that permits manipulation of the serial data signal to effect time based organ effects such as the pizzicato and sostenuto with complete control. Lastly, it is the conversion of the parallel input, spacially and chromatically related information of the keyboard into a time based chromatic serial signal that permits the entire array of information inputted via the manual keyboards, coupler and stop keys to be transmitted via a very few conductors to the chest magnets of the organ pipes to effect speaking thereof.

Referring now to FIG. 2, there is illustrated in detail the main circuitry of master oscillator 186. Master oscillator 186 comprises a pair of serially connected inverters 192, 194 connected by a capacitor 196 and resistors 198, 200 to form a conventional R-C astable multivibrator. The values of resistors 198, 200 and capacitor 196 are selected to provide an oscillator frequency of about 11 khz. A buffer 202 is connected to the output terminal 204 of the multivibrator circuit and provides a non-inverted clock signal hereinafter denoted as clock signal "C". Buffer 202 may in fact consist of any even number of inverting stages with the only requirement being that the final stage be one having one or more parallel-driven HINIL circuits to provide the necessary drive capability to supply the clock signal "C" to all those portions of circuit 10 requiring same. This signal is illustrated in FIG. 3.

The other two signals illustrated in FIG. 3 are a load signal "L" and a synchronizing (sync.) signal "S". These two signals are generated by a timing signal circuit indicated generally at 206 which is coupled through an inverter 207 to the output terminal 204 of the multivibrator.

Circuit 206 includes a flip-flop 208 including cross coupled NOR gates 210, 212. When flip-flop 108 is in its set condition, gate 212 will generate a logic 1 output at its output terminal 214. This signal is applied to the reset terminal 216 of a binary counter 218. This assumes that the inverted clock signal outputted from inverter 207 is at logic 0 such that flip-flop 208 is not immediately reset thereby. The signal appearing at output terminal 214 of gate 212 is again outputted via a HINIL buffer 220 to provide a load signal "L" at output terminal 222, this signal being shown as signal "L" in FIG. 3.

Next in sequence, an inverted clock signal, denoted as "C" from output terminal 215 of buffer 207 outputs a positive going transition which transition effects the reset of flip-flop 208, terminating the logic 1 appearing at output terminal 214. Correspondingly, the load signal "L" and the reset signal applied to binary counter 218 go to logic 0.

Binary counter 218 now increments in response to each negative going transition received from inverter 207 following the clock signal that resets flip-flop 208. This continues through the 108th transition or clock pulse. In response to the 108th such negative-going transition, the binary coded output of counter 218 appearing at output terminals 224 thereof will produce logic 1 signals at predetermined ones of the terminals 224 corresponding to the binary equivalent of the decimal count 108. These signals are applied to the input terminals of AND gate 226, gate 226 generating a logic 1 at its output terminal 228 in response thereto. This logic 1 signal is applied to input terminals 230, 232, respectively, of AND gates 234, 236. At this point of time, the output signal appearing at the "Q1" output terminal 38 of counter 18 is at logic 0 and the inverted clock signal appearing at output terminal 215 of inverter 207 is also at logic 0 and the outputs from the AND gates 234, 236, both remain at logic 0. However, upon the occurrence of the next positive-going transition of inverted clock signal "$\overline{C}$" at terminal 215, AND gate 236 is enabled to generate a logic 1 at its output terminal 240. This signal is passed via a buffer 242 to produce the sync. signal "S", shown in FIG. 3. Buffer 242 again has HINIL output to provide sufficient drive capability to supply the sync. signal "S" to the remainder of the circuits.

In response to the next negative going transition of the inverted clock signal appearing at terminal 215, counter 218 increments to generate a logic 1 signal at its "Q1" output terminal 238. This signal in combination with the output signal appearing from AND gate 226 causes AND gate 234 to generate a logic 1 output signal at its output terminal 244. This signal, appearing at terminal 244, is applied to the reset terminal 246 of flip-flop 208 resetting same whereby flip-flop 208 generates a logic 1 at terminal 214, this transition occurring before the execution of a subsequent clock transition. This results in resetting of the binary counter 218 and the generation, again, of a logic 1 signal at terminal 222. It will be observed that this sequence will then repeat through the next 109 complete clock cycles. It should be observed that the logic 1 state of the load signal "L" and that of the sync. signal "S" occupy in time alternate halves of one complete clock cycle, and these signals repeat once for each 109 complete clock cycles. The various circuits of the circuit 10 are configured to respond to the clock signal "C" such that binary data transmitted to the rank drivers 160 through 168, as will be explained below, is in fact static between positive going clock transitions. The rank drivers 160 through 168 are designed to sample the data inputted thereto during negative going clock transitions. This reduces if not totally eliminates the undesirable effects of degraded transmission media, differences in transmission delay between the timing and data signals, and transients which may occur during changes in the transmitted data.

Referring now to FIG. 4, there is illustrated the detail of a typical input register such as input registers 106 through 116. Since each of the input registers is substantially identical, an explanation of input register 106 will suffice for all. Register 106 consists essentially of a 61 stage cascaded parallel input-serial output shift register. Such registers can in practice be fabricated from a string of eight 8-stage parallel input-serial output shift registers such as industrial type 4021 to form a single 61 stage register 250. Register 250, in turn, has 61 parallel inputs 252 which are connected to the key switches of a typical organ keyboard (not shown). The organ keyboard (not shown) typically has a common feed buss supplied by a positive voltage and the key switches are normally open. Closure of a key and the corresponding contacts thereof produces a positive voltage or a logic 1 on a particular one of the input terminals 252. Each of the input terminals 104 automatically returns to a logic 0 in the absence of a contact closure through the provision of a bleed or "pull down" resistor 254 connected thereto. It is also desirable to provide series resistors 256 connected electrically in series between the key contacts and input terminal 252 for protection of the register 250, the latter preferably being a CMOS circuit, from potentially destructive transients.

In practice, the bottom note of a keyboard (the note having the lowest pitch) is connected to the parallel input of register 250 at the extreme end of register 250 towards which data is shifted. Each chromatically successive note is connected to the next lowest order register 250, the lowest pitch data bit is the first data bit to be outputted. Clock pulses "C" and load pulses "L" are supplied to register 250 through input terminals 258, 260, respectively. In response to a load pulse "L" at terminal 260, which pulse is first buffered by means of a buffer circuit 262, register 250 is conditioned to parallel load the data on terminals 252 thereinto. Each inoperative key of the manual keyboard (not shown) inputs a logic 0 into register 250 and each depressed key of the manual will enter a logic 1 into the register 250 during such a load pulse. Once the data from the manual (not shown) is loaded in parallel into register 250, it will be seen that the sequential position of the individual binary data bits in the register 250 corresponds to the spacial relationship of the keys of the manual. Thus, the binary content of the last (61st) register stage is, during the occurrence of the load pulse, responsive directly to the logical condition of the bottom note switch of the keyboard manual. Upon termination of a load pulse, the "Q61" output terminal 264 retains the logical condition of this last mentioned switch until the next positive going transition of the clock signal "C" which occurs ½ clock cycle after the termination of the load pulse "L". Since the clock "C" signal is applied to register 250 through a suitable buffer 266, the first such positive going transition will shift all of the data in the register down one stage towards the last (61st) stage such that the data output line 268 will output, between the first and second positive going clock transitions following the load pulse, a logic level representative of the condition of the second from the lowest-pitch note switch. This sequence continues for each succeeding positive going transition of the clock signal "C" for 61 consecutive clock cycles.

It will further be observed that the serial input terminal 270 of register 250 inputs thereinto a logic 0 by conductor 272 connected to a suitable system ground 274 such that, as the data is serially shifted out of register 250 via terminal 264, logic "0's" are simultaneously shifted into register 250 until, during the 62nd clock cycle, all 61 stages of register 250 contain logic 0's. This condition remains during the 48 subsequent clock cycles, until the next load pulse when the parallel data from the manual (not shown) is again loaded thereinto.

Pedal input registers 114, 116 (FIG. 1) are identical in form and function to the manual input register 250 of FIG. 4 except that they consist of only 32 stages which in turn corresponds to a conventional 32 note capacity pedal keyboard. Similarly, these registers are capable of outputting only 32 data bits before all data corresponds to logic 0's.

A manual will comprise, typically, 61 keys arranged in chromatically ascending from left to right, sequence with the leftmost key being assigned to the lowest pitch note that can be played on the manual. In the case of a piano or an organ having but one 61 pipe rank, the bottom key of the manual will always effect the production of a note having a single, fixed pitch. In a typical pipe organ, however, there will be a plurality of ranks of organ pipes. For example, the organ may include a flute voiced rank of pipes, including 61 individual pipes, the lowest pitch pipe being an 8 foot pipe, and a second flute voiced rank of pipes, 61 in number (and assuming no unification is employed), in which the lowest pitch pipe being sixteen foot pipe. When the manual is connected to the 8 foot rank, the 8 inch pitch pipe will be sounded when the bottom key of the manual is depressed. Similarly, when the manual is connected to the 16 foot rank, the bottom note of the keyboard will activate the 16 foot pipe, and connection of both the 8 inch and 16 inches ranks to the manual will enable operation of both the 8 foot and 16 foot pipes by the same bottom key.

In a conventional organ, the chromatic relationship of the keys to the organ pipes of different ranks is as stated, effected by means of a three dimensional switching matrix. In the present invention, the third dimension is replaced with time and it becomes necessary to preserve the chromatic relationship of the notes, pipes and keys in the time based serial data signal. This is done by assigning a time position in the serial data signal to a particular one of the pipes of a rank.

Further, recognizing that in a unified organ, an extended rank of pipes functions as a plurality of ranks having overlapping portions, it will be seen that, to provide a serial data signal having a data bit for each pipe of a rank, extended or not, there must be a data bit position for each pipe of the maximum sized extended rank. For practical reasons but not as a limit, it has been assumed that such an extended rank of pipes will include no more than 109 pipes. The first data bit of each serial data signal is assigned to the lowest pitch pipe of an extended rank. Each successive data bit in the serial data signal is assigned the chromatically successive pipe of the extended rank. Irrespective of which portions of an extended rank of pipes is being used, this time position of the data bits to the chromatic relationship of the pipes of the rank does not change.

Figure 5:
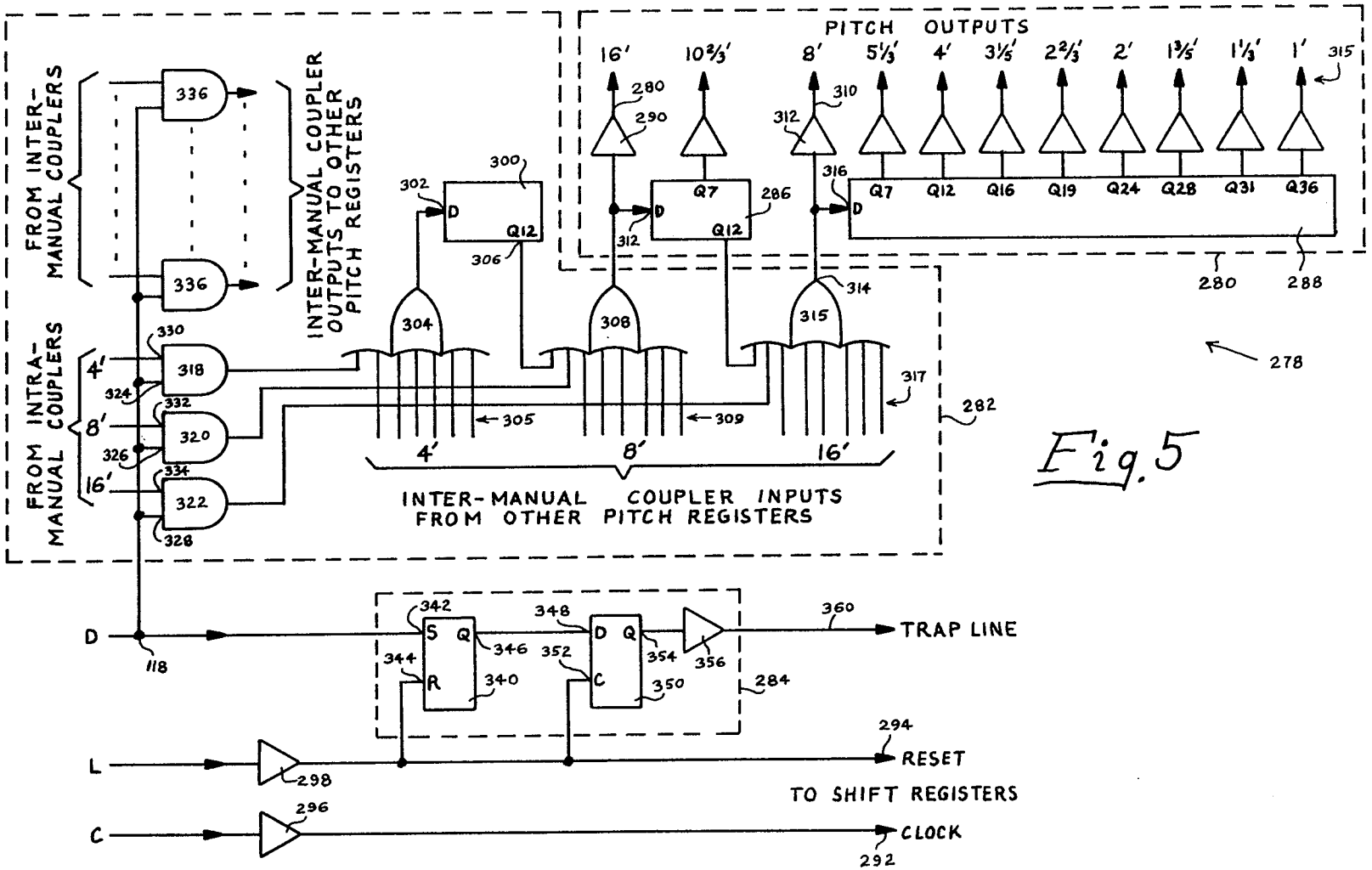
FIG. 5 is a logic diagram illustrating the operation of the pitch registers of the present invention.

With this in mind and now referring to FIG. 5, there is illustrated the logical arrangement of a pitch register such as pitch registers 122 through 132 in FIG. 1. Again, all of these pitch registers are substantially identical and an explanation of one, denoted generally as pitch register 278 in FIG. 5, will suffice for all. Pitch register 278 comprises generally a pitch generating means shown in dashed line box 280, a coupler means enclosed in dashed line box 282 and a trap line means shown in dashed line box 284.

The pitch generating means 282 includes 48 stages of serial input-parallel output shift registers 286, 288 which may be implemented by cascading multiples of 4 or 8 stage serial input-parallel output shift registers such as industry type 4015. The serial input to the 12 stage register 286 is buffered and outputted directly to provide one of the eleven pitch output signals, which appear on terminals 315 denoted "Pitch Outputs", this first pitch signal appearing at terminal 280 via buffer 290. This output is denoted as 16 feet and is used, as will become apparent later, to operationally couple a manual or pedal keyboard to one or more selected ranks of organ pipes such that the lowest pitch note of each such rank thus enabled is that of a 16 foot open ended pipe.

The parallel output of the 12th stage of register 286, which is denoted as "Q12" is applied to one input of a multiple input OR gate 315 (unless additional signals are injected through the otherwise vacant input of OR gate 315). The "clock" input and "reset" inputs (not shown) of registers 286, 288, are connected to receive the clock "C" and load "L" pulses above described from terminals 292, 294, respectively, both of these signals again being buffered by conventional buffers 296, 298, the respective inputs of which in turn are connected to the clock signal "C" and load "L" terminals 221, 222 (FIG. 2). Thus connected registers 286, 288 are reset in response to each load pulse "L" and shift in binary note data serially in response to each subsequent positive going clock transition. An additional serial input-parallel output register 300, whose function will be explained below, similarly has its clock and load terminals (not shown) connected to receive the clock "C" and load "L" pulses from terminals 292, 294, its data input terminal 302 connected to the output of multiple input "OR" gate 304, and its 12th stage output terminal 306 connected to one input of another multiple input OR gate 308. Register 300 thus similarly responds to the load "L" and clock "C" signals as above described with reference to registers 296, 288.

It should be noted that the designations in "16 feet", "10⅔ feet", and "8 feet" etc. of terminals 315 (FIG. 5) apply to a unison pitch (8 feet) stop or coupler initiated pitch output signal. For example, if an 8 foot coupler tab has been activated for this particular pitch generating means 278, AND gate 320 will be enabled and the serial data signal on line 118 will pass therethrough to one of the inputs 309 of OR gate 308. Thus conditioned, when the lowest or left most key of the manual is depressed, a logic 1 binary data bit will be generated in the first data bit position of the serial data signal. This data bit will pass through AND gate 320 and OR gate 308 and be outputted on the 16 foot pitch output terminal 280 without any change in its time based position with respect to the serial data signal. Further recalling that the first data bit position contains information for activating the lowest pitch pipe of an extended rank, it will be seen that this first logic 1 signal should ultimately effect activation of a 16 foot pipe. Similarly, the 8 foot pipe of the same rank, which has a pitch one octave higher than the 16 foot pipe will ultimately be activated by logic 1 signals appearing in the 13th data bit position of a serial data signal. Correspondingly, the logic 1 bit inputted to AND gate 320 from the manual by activation of the left most key thereof will pass through AND gate 320, OR gate 308 and be inputted to data input terminal 312 of shift register 286. Twelve clock pulses later, the signal will appear at the "Q12" output terminal of register 286, be inputted to one of the inputs 317 of OR gate 315, and outputted on terminal 310. Thus, it will be clear that depression of the left most key of the manual will generate a logic 1 output signal at terminal 310, designated as the 8 foot pitch output, simultaneously with the occurrence of the 13th clock pulse signal. This of course is the data bit position corresponding to the lowest pitch note of an 8 foot rank of organ pipes.

On the other hand, depression of the same manual key and activation of a 16 foot coupler will cause this logic 1 data bit to be passed through AND gate 322 directly to one of the inputs 317 or OR gate 315. This same data bit, without any shift in its time position with respect to the serial data signal, will be outputted on the pitch output terminal 310 designated as the 8 foot pitch output. In fact, these signals, i.e. the data bits passing through AND gate 322, are not really 8 foot pitch outputs with respect to a 16 foot stop key input. Nonetheless, these designations are useful inasmuch as the data bits appearing on each of the pitch outputs will have a time relationship to the serial data signal such that the data bits appearing thereon will correspond time wise to the data bit position of a pipe having the pitch output designation.

Serial data routed from an input register such as solo register 106 (FIG. 1) may be routed through AND gate 320 and OR gate 308 to data input terminal 312 of register 286 and buffer 290. The serial signal appearing at the 16 foot pitch output terminal 280 will be, for any given combination of played or depressed manual keys, an exact reproduction of the input register data appearing on data line 118 feeding, among other things, AND gate 320. Again for example, if the bottom note of the keyboard is depressed, a binary one data bit will occur in the first data bit position of the serial data signal appearing in data line 118. The signal on the 8 foot pitch output however, will normally be at logic 0 during the first 12 clock cycles. However, beginning with the 13th clock cycle, the same logic 1 bit will appear at the 8 foot pitch output terminal 310 via buffer 312 which appeared at the 16 foot output terminal 280 during the first clock cycle.

Similarly, because of the time relationship of the data signal to the spacial relationship of the keys of a manual, the signal corresponding to tenor C (the 13th note from the bottom of the keyboard) will occur on line 118 during the 13th clock pulse of any serial data signal. Thus the data bit occurring at terminal 310, which was initiated by depressing the tenor C key of the manual is now, by means of the digital delay of register 286, shifted to a time position in the serial data signal corresponding to a tenor C. This same effect will occur for the depression of any other key of the manual. Similarly, by using successive stages of shift registers 288, and tapping the outputs therefrom from selected ones of the parallel outputs thereof, bottom C, or for that matter, any other note or group of notes, can be obtained as having been shifted into a time position in the data signal corresponding to different pitch notes. Shifting such a signal by 12 clock pulses (one octave) provides transposition of the manual signal in octave intervals and mutation transpositions can be obtained by selecting register outputs displaced by four, seven, or other numbers of register states within the various octaves. For example, as illustrated, a 10⅔ foot, 5⅓ foot, 3 1/5, foot, 2⅔ foot, 1 3/5, foot, and 1⅓ foot mutation outputs can be obtained by such time shifting of a data signal.

Still referring to FIG. 5, the coupler means 282 in more detail includes OR gagte 308, above described, which provides the 8 foot or "Unison", coupler pitch inputs. Thus OR gate 308 provides a means of introducing a serial data signal into the data input terminal 312 of register 286 from the like-designated keyboard input register (e.g. solo input register feeds solo pitch register). OR gate 308 further provides a means for introducing serial data into terminal 312 from other input registers or from other sources, such as for example, shift register 300 which receives data via terminal 302 from OR gate 304 which in turn receives data signals via its multiple input terminals 305 from one or more different input or pitch registers and delays these inputted signals by 12 clock pulses. Correspondingly, the data bits of a signal injected into the serial data signal through OR gate 304 will reach the 8 foot pitch output at the same time that the same data bits, injected through OR gate 308 will reach the 4 foot pitch output. Thus it is seen that this circuit can shift groups of manually-inputted note signals, on a per-manual basis, to 4 foot pitch and thereby provides a plurality of 4 foot coupler pitch inputs.

In another function, OR gate 315 has an output terminal 314 coupled by a buffer 312 to the 8 foot pitch output terminal 310 and directly into the data input terminal 316 of register 288. In effect, therefore, a signal inputted directly to OR gate 315 bypasses register 286 in such a manner as to advance the signal injected into its input terminals 317 by 12 clock cycles with respect to the same signal being injected into OR gate 308. This has the effect of shifting the time position of these signals to represent notes one octave lower. This group of inputs is therefore designated 16 foot coupler pitch inputs. It will be observed that the signals injected into OR gate 315 never reach the 16 foot pitch output by reason of the direction in which these signals propagate through register 286. This characteristic provides an intentional and additional advantage which will be discussed below.

Intra manual coupler controls are, as stated, provided by means of AND gates 318, 320, 322. Each of AND gates 318, 320, 322, have one input terminal thereof, 324, 326, and 328, respectively, coupled to the data line 118 such that they will receive the data signals from the input register associated directly with this pitch register. By reason of the AND gates 318, 320, and 322, which also have their remaining input terminals 330, 332, and 334 connected to specified intra-manual coupler keys, these AND gates can be utilized to selectively route the signal from data line 118 to any combination of 16 foot, 8 foot, or 4 foot coupler pitch inputs. That is, if the logic 1 signal is received at terminals 330, 332, or 334 by reason of activation of the respective manual coupler key, the corresponding AND gate will switch on or be enabled, whereby, the data signals on data line 118 will pass therethrough.

Inter-manual coupler controls are provided by means of a plurality of AND gates indicated generally at 336. These are identical in electrical form and function to AND gates 318, 320, 322, except that their outputs are free to be connected, to an appropriate combination of 4 foot, 8 foot, and/or 16 foot coupler pitch inputs of pitch registers other than the one to which gates 336 belong. Under the manual control of coupler keys connected to corresponding inputs of gates 336 the particular keyboard, whose input register signal these gates are configured to receive and switch, may thus be made to operate selected portions of the organ otherwise programmed to be operable as groups only from one or more corresponding keyboards other than the one from which said signal originates. These portions of the organ are operable in addition to such other portions normally programmed in association with the keyboard to which they are coupled. Further, it can be seen that sich inter-manual coupling control may be exercised at one or more of a plurality of musical pitches, depending upon the pitch designations of the particular coupler pitch input terminals to which the outputs of gates 336 are connected.

Gate 336 may also be used to selectively route input register signals to other functional modules such as a pizzicato circuit and the like.

Connections through all coupler stop key switches are again normally open, single pole switches having a common buss connected to a source of positive potential to provide a binary or logic 1 signal upon closure and pull down resistors to provide a binary or logic 0 signal when the switch is open.

The trap line means 284 includes a set-reset flip-flop 340 having its set input terminal 342 connected to the data line 118, and its reset input terminal 344 connected to the output of buffer 298 to receive the load "L" signal. The output of flip-flop 340 appearing at terminal 346 is applied to the input terminal 348 of a clocked D type flip-flop 350. Flip-flop 350 has a clock input terminal 352 connected, again, to receive the buffered load "L" signal from buffer 298 and an output terminal 354. A suitable buffer 356 is again connected to output terminal 354 to condition the trap line signal. In operation, logic 1 note signals appearing on data line 118 correspondng to the actual manual notes activated are applied to the set input terminal 342 of flip-flop 340, whereby, each depressed key of the manual will produce a logic 1 at this terminal to set flip-flop 340 during each particular clock cycle corresponding to an energized or activated note key. This occurs typically during the first 61 clock cycles of each data sequence. Since the load signal "L" is connected by a buffer 298 to the reset input 344 of flip-flop 340 and also to the clock input terminal 352 of flip-flop 350, a logic 1, which established a set condition of flip-flop 340, will be clocked into flip-flop 350 in response to the load "L" pulse which begins the next data sequence. This same load pulse will also simultaneously reset flip-flop 350. The output occurring at terminal 354 of flip-flop 350 is connected again, through buffer 356, to a trap line output terminal 360. It will be seen that the output appearing at terminal 360 will be a static logic 1 whenever at least one note of the respective manual is being played and this static logic 1 signal will continue for the approximate duration of the manual's activation. Conversely, if none of the notes of the particular manual are being played, a logic 0 signal will appear at terminal 360, again for the duration of the manual's idle condition. This will be recognized as the required "trap" or rhythm signal with substantially instantaneous response being asked.

Referring now to FIG. 6, there is illustrated the logical circuitry of the rank-stop combiner such as the "Flute" rank-stop container 148 of FIG. 1. Again, each of the rank-stop combiners is substantially identical and the description of the "Flute" rank-stop combiner will suffice for all. In overview, the rank-stop combiner, indicated generally at 360 incorporates a plurality of two-input AND gates 362 each of which has one input terminal 364 thereof connected to a stop key associated with a particular manual. Terminals 364 receive a logic 1 signal or a logic 0 in response to the operative or non-operative positions of the corresponding stop key, respectively. The exact connections (not shown) preferably include pulldown and series-input resistor, in a configuration identical in form and function to those described for coupler stop key inputs and those depicted in FIG. 4 to interface the note inputs 104. Each of AND gates 362 has its remaining input terminal 366 connected to receive signal from a selected different pitch output of a selected pitch register such as 8 foot pitch output 310 in FIG. 5. The output terminals 368 of AND gates 362 are connected to arbitrary ones of the input terminals 370 of a multiple input OR gate 372. The output terminal 374 of OR gate 372 is connected through another buffer 376 to a data output terminal 378. With this circuitry, various combinations of the serial data appearing at pitch outputs of register 280 (FIG. 5) and of other similar pitch registers associated with other manuals are selectively passed by the AND gates 362 when the respective AND gates are enabled by an operation of the stop key connected thereto. This serialized data is then combined in OR gate 372, boosted and conditioned by buffer 376 to provide a combined or composite serial data signal at output terminal 378. The composite serial data signal may thus include data being outputted from selected different pitch outputs of specified different pitch registers such as the "Solo", "Great", or "Accompaniment" pitch registers 134, 136, and 138, respectively. This composite signal, as will be explained in detail below, is then directed to various organ pipes within a specific rank or the various notes of a specific tuned percussion through the rank driver circuitry.

In addition, each of the combiner modules of FIG. 6 is provided with a pair of inverting line drivers 380, 382 connected to the clock "C" terminal 221 (FIG. 2) and the sync. "S" signal output terminal 243 (FIG. 2) respectively to provide the inverse of the clock "C" and sync. "S" signals, hereinafter denoted as "$\overline{C}$" and "$\overline{S}$", these signals being supplied to each of the rank drivers, along with the serial data signal.

Referring now to FIG. 7, there is illustrated the logical circuitry of the rank drivers such as "Flute" rank driver 160 of FIG. 1. Once again, each of the rank drivers is substantially identically as a description of one will suffice for all. The driver is indicated generally by numeral 386 and generally provides a means for receiving the serialized date stream, separating the individual data bits thereof and providing a parallel, spacially related signal for activating the chest magnets and thereby the individual organ pipes of the organ.

Note that it has been assumed that, as a reasonable but not mandatory limit, no extending rank of organ pipes will in fact exceed 109 notes (9 octaves). Thus, with a clock pulse frequency of 11 khz. a frequency selected for reasons explained below, the required number of clock pulses to serialize the 109 notes will require about 10 milliseconds. Further consider that the ultimate objective of the serialized data is to energize selected ones of the chest magnets which control the pipes of a rank or the notes of a tuned percussion. It is intended that these chest magnets will be energized in response to logic 1 signals occurring in the serial data stream during predetermined individual ones of the 109 separate pulses of the 109 pulse clocking sequence. Thus, means must be provided to retain the state "on" or "off" corresponding to each of the signals in the serial data train during the remaining 108 data pulses. This is, of course, necessary to prevent the individual chest magnets from changing their operating states between updated data pulses. One obvious solution to this would be to provide a 109 bit latch connected to the outputs of a shift register such that, as the data from the shift register is transferred, the latch outputs only respond to a sync. "S" pulse which occurs at the end of each serial data signal transmission sequence. These data bits would then be stored until the next sync. pulse and the necessary control signal would thus be generated for the chest magnets.

However, a more economical solution, and the one embodied in the present invention, is to generate the 11 khz. master clock signal and frequency divide same to generate a secondary clock signal havng $\frac{1}{8}$th the master clock frequency. This reduced frequency clock signal is then used to increment a binary counter whose outputs are in turn connected through a gated one-of-fourteen decoder to clock a plurality of shift registers one at a time. Using this configuration, it will be shown that any particular shift register will only be in a state of change for about 6.42% of the entire transmission sequence and will remain static during the remainder of the transmission of sequence. Thus, utilizing the above specified clock frequency, the transition period, that is, the period during which any particular one of the plurality of shift registers is in a state of change, will be only about 0.64 milliseconds. It has further been determined that the response time of the chest magnets, which themselves are essentially slow acting mechanical-inductive devices, is slower than 0.64 milliseconds such that this time period is too fast to permit the chest magnets to respond thereto. Thus, the chest magnets will only respond to actual (static) changes in the particular shift register output associated therewith, this static period being the remainder of the data transmission sequence.

This circuitry is illustrated in FIG. 7 wherein the rank driver, indicated generally at 386, is shown logically. The data signals "D", inverse clock signal "$\overline{C}$" and inverse sync. signal "$\overline{S}$" are received at respective input terminals 388, 390, and 392. Each of these signals is sequentially passed through a low pass filter 394 and a Schmitt trigger or pulse shaper 396 to produce clean, strong data "D", inverse clock "$\overline{C}$" and inverse sync. "$\overline{S}$" signals at terminals 398, 400, and 402, respectively. Preferably, filters 394 are configured to admit the fundamental frequencies of the transmitted signals, and attenuate the upper harmonics thereof and in particular, the high-frequency interference signals which may be induced in the system through signal cross-talk or from external interference sources. The Schmitt triggers 398 are provided with voltage hysteresis, that is, a peak voltage signal swing threshold, at their inputs, which must be exceeded if the triggers are to respond. By setting these thresholds high enough, most interference signals, when attenuated by the filters 394, will be too small to exceed the threshold of the Schmitt triggers 396. Said Schmitt triggers also restore the upper harmonics of the signals which they are intended to receive, thereby producing noise free reconstructions of the data, inverted clock, and sync. signals "D", "$\overline{C}$", and "$\overline{S}$" at their outputs 398, 400, 402, respectively. The data signal appearing at terminal 398 is applied simultaneously to the input terminals 404 of a plurality of serial input-parallel output shift registers 406. Shift registers 406 may be provided in the form of industry type 74164 8-bit shift registers. Thus connected, the serialized data outputted from terminal 398 is simultaneously fed into the inputs 404 of the registers 406.

Registers 406 further have a clock input terminal 408, each of the clock input terminals being connected to a predetermined different one of a plurality (14 in the present embodiment) of output terminals of a gated "4 to 16" line decoder 412 such as an industry type 74154. These outputs 410 are denoted "Q1" through "Q14" and each of the "Q1" through "Q14" outputs are at logic 1 except for a predetermined one of the outputs which may be at logic 0 as determined by the binary combination of logic signals applied to the four input terminals 414. Otherwise stated, input terminals 414 provide an address input which determined which one of the outputs 410 may be at logic 0.

Also provided in register 412 is a gate input terminal 416. A logic 1 signal applied to gate input terminal 416 forces all of the outputs on terminals 410 to a logic 1 condition, this gate terminal inputting the inverse and conditioned clock signal "$\overline{C}$" appearing at terminal 400. Terminals 414 are in turn connected to receive signals from the fourth through the seventh binary outputs 418 of binary counter 420, the "clock input" of counter 420 also being connected to receive the signal from terminal 400. The reset terminal 422 of counter 420 is connected via AND gate 423 to terminals 400 and 402 such that it will respond to the simultaneous occurrence of a logic 1 state of the inverse clock "$\overline{C}$" and a logic 0 state of the inverse syn. "$\overline{S}$" signals applied to its input terminals 424, this occurring once during each data transmission sequence. Thus connected, decoder 412 may generate a logic 0 signal at a particular selected output terminal 410 thereof with the selection of outputs changing in response to every 8th positive going transition of the inverse clock signal "$\overline{C}$". Because the inverse clock signal "$\overline{C}$" is also applied to the gate input terminal 416, each of the fourteen outputs of decoder 412 will, in fact, produce a group of eight logic 0 pulses, thus duplicating the inverse clock signal "$\overline{C}$" during that portion thereof, before the same sequence will appear at the next selected output.

Assuming that binary counter 420 is in its 0 state in response to a reset signal applied to its terminal 422, the "Q1" one of terminals 410 will be activated whereby an initial logic 0 pulse will be applied to the clock input terminal 408 of the particular one of registers 406 connected to said "Q1" terminal. Thus in sequence, during the first 8 logic 0 pulses, the first eight data bits or data signals which appear at terminal 398 are shifted into the first of registers 406. While the same data is also applied to the data inputs 404 of the other registers 406, these other registers remain idle since the respective ones of the "Q" terminals 410 connected thereto remain at a logic 1. This causes the outputs of the other registers 406 to retain the contents of any previous data entered thereinto. During each 8th positive going clock transition, the outputs on terminals 410 of decoder 412 will be conditioned to output a series of eight logic 0 pulses to the next successive one of registers 406.

During the next 8 clock pulses, the next 8 data bits appearing at terminal 398 are shifted into the second in the sequence of the shift registers 406 thereby conditioning its outputs to output eight static parallel signals corresponding to the next eight notes of the particular rank of organ pipes being controlled thereby. This same sequence continues for each of the registers 406. It should be observed that the final one of registers 406 will in fact receive only five clock pulses, and thus only utilize five of its outputs to complete the full 109 note output compliment utilizing fourteen eight-stage shift registers 406. Next in the sequence, the sync. pulse and the final clock cycle are applied to AND gate 423 to generate a logic output therefrom which is applied to the reset terminal 422 of counter 420 resetting same back to a 0 count. At this point of time, the sequence repeats.

It should be observed that the only period during which data outputted from any one of registers 406 is in a state of change is during the first seven of the eight clock cycles when that particular register is being loaded. Each of the registers 406 remain static during loading of all other shift registers thereby effecting the short 0.64 millisecond transition period. As stated above, this provides a transition period and static periods for the outputted signals sufficient to prevent any response by the chest magnets to other than the static signals and thereby prevents response to other than actual manipulation of the keys of the organ manuals.

Drivers or amplifiers 428 are coupled between the registers 406 and the chest magnets (not shown) to provide adequate current drive for a chest magnet, which typically requires 100 to 200 milliamps of current at 10 to 15 volts. These drivers, 428, may be provided in the form of an integrated array of Darlington transistor pairs having base limiting resistors and clamping diodes connected to open collector outputs. Such a package is commercially available in packages of seven Darlington pairs with a common emitter and common diode clamp buss. By returning the clamp buss to the positively-fed magnet common buss, inductive transient signals will be diverted through clamp diode when the magnet is released. This same circuitry also has the effect of maintaining current through the chest magnet via the diode during the brief periods of invalid data such that interruptions of current resulting from such invalid data occupies a maximum of only about 3% of the total time of the signal or about 300 microseconds.

As described to this point, there is provided an organ relay or control system which provides all the basic coupling and stop control functions for an electropneumatic pipe organ and which easily enables organ unification. The system as described thus far, effects this operation by serializing the parallel generated data of a manual keyboard. While the description has been presented with reference to a single input register, pitch register, rank stop combiner, and rank driver, this same circuitry is repeated for each additional manual and/or rank of organ pipes provided in the system. Even in a highly complex system, however, it will be seen that the number of wires required between the control console and ranks of organ pipes is reduced from a substantial multiplicity of such connections to as few as three wires per rank. Further, all of the coupling and stop tab connections are easily effected via a minimal number of connections between the logic assemblies and these connections can in fact be preconnected to configure the relay system of the present invention for any desired installation. The number and difficulty of the connections is, in any event, substantially reduced. To this point, all of the efficiencies of the system have been effected through the device of transposing spacially related information inputted into the organ manual via the keyboard, into a serialized data train comprising 109 chromatic data pulses in each data transmission.

There are, however, other "embellishments" or accessory features that are frequency utilized and desirable in a pipe organ which are time dependant, such features being a pizzicato, reiteration, sostenuto and the like controls. Since all of the musical note data information for the system is already converted to a time basis in the relay system, further manipulation of the data on a time basis during transmission is easily effected by additional circuitry as described below.

The first of the accessory circuits to be described is a "reiteration" circuit shown as 172 in FIG. 1. Reiteration circuit 172 is inserted to receive the serial data stream transmitted from one or more of the pitch outputs (FIG. 5) of one or more of the pitch registors 280, the output of the reiteration circuit 172 being transmitted to a selected rank-stop combiner such as rank-stop combiners 148 through 156 (FIG. 1) and shown in detail in FIG. 6. The reiteration circuit 172 processes data signals typically directed to a tuned percussive instrument or device and has the primary function of periodically inhibitting the logic 1 bits corresponding to percussive notes which have been played on a manual such that the notes, when sustained or maintained in a depressed position, will in fact, reiterate or repeat. Further, to enable the circuit to more closely mimic the action of the interrupter contacts, which have heretofore been conventionally attached to each note of the tuned percussive devices in order to achieve the desired result, it is provided with means to inhibit, alternately, logic 1 data bits which occur during even and odd numbered clock cycles and means to disable the inhibiting means for both groups of clock cycles for a brief period following keyboard attack. This assurres that a certain number of logic 1's will be enabled regardless of whether the first pulse is even or odd immediately following keyboard attack.

Figure 8:
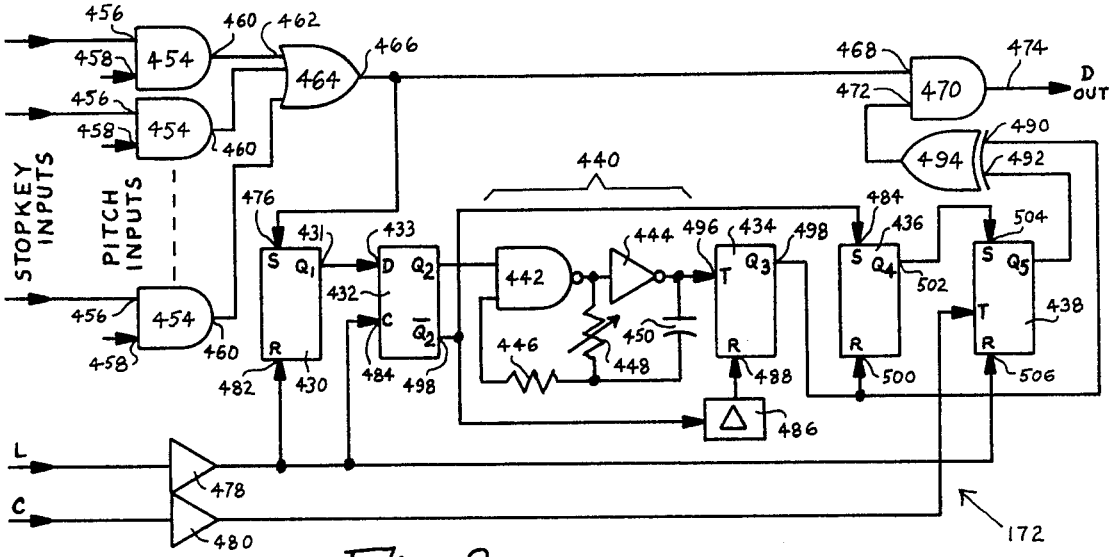
FIG. 8 is a circuit diagram showing details of the reiteration circuit for use in the present invention.
Figure 9:
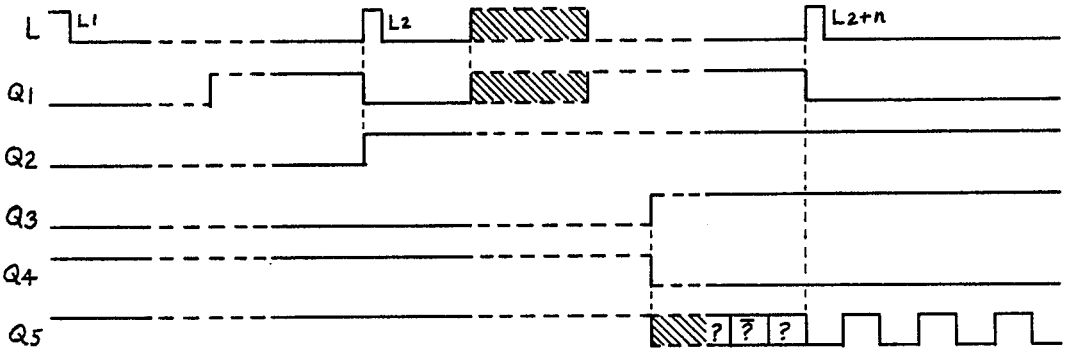
FIG. 9 is a chart illustrating the time relationship of significant signals in and useful for explaining the operation of the reiteration circuit of FIG. 8.

Referring now specifically to FIG. 8, which shows the reiteration circuit, and FIG. 9, which illustrates a time relationship of the more important logic voltage wave forms occurring in the circuit of FIG. 8, it is seen that the basic elements of the reiteration circuit 172 comprise five flip-flops 430, 432, 434, 436, and 438, a gated astable multivibrator 440 including AND gate 442, inverter 444, resistors 446, 448, and capacitor 450 conventionally connected, and related logic gates. Flip-flops 430 and 436 are set-reset types, flip-flop 432 is a clocked-D type, and flip-flops 434 and 438 are of the toggle type with a set-reset capability.

The main signal paths into circuit 172 are via a plurality of AND gates 454, each of AND gates 454 having a pair of input terminals 456, 458, connected to receive enabling signals from the stop keys and signals from the pitch outputs (FIG. 5), respectively. The outputs of AND gates 454 appearing at terminals 460 are inputted into terminals 462 of multiple input OR gate 464. The logical function of this circuit is identical to the similarly illustrated combiner circuit 360 (FIG. 6). The output signal from OR gate 464 appearing at terminal 466 is applied to one input terminal 468 of AND gate 470 whereby the combined signals appearing at terminal 466 can be selectively inhibited by operation of the AND gate 470 via signals applied to the latter's remaining input terminal 472. The output of AND gate 470 appearing at terminal 474 is the data signal modified by the reiteration circuit 172.

Flip-flops 430, 432 are substantially identical in configuration to the trap line circuit 284 of FIG. 5 with the combined data signal from OR gate 464 being applied to input terminal 476 of flip-flop 430, the load "L" signal again being conditioned by buffer 478 and applied to the reset and clock terminals 482,484 of flip-flops 430, 432, respectively. The function of flip-flops 430, 432 differs from those illustrated in FIG. 5, however, in that flip-flop 432 provides complimentary unbuffered outputs denoted "Q2" and "$\overline{Q2}$" and flip-flop 430 receives its set input from OR gate 464 instead of directly from an input register data output. Thus, if no serial note signals are being inputted to this particular percussion control channel, flip-flops 430, 432, are in their reset conditions. The "$\overline{Q2}$" output of flip-flop 432 therefore outputs a logic 1 in response to this condition, this output being connected to the set input terminal 484 of flip-flop 436 and, simultaneously, through a delay circuit 486 to the reset input terminal 488 of flip-flop 434, thus causing a logic 1 to be outputted from the "Q4" outputs 502 of flip-flop 436, and a logic 0 to be outputted from the "Q3" output 498 of flip-flop 434.

since the "Q4" output 502 of flip-flop 436 connects to the set input 504 of flip-flop 438, flip-flop 438 is also placed in a set condition. The outputs denoted as "Q3" and "Q5" of flip-flops 434, 438 are applied to the input terminals 490, 492, respectively of an exclusive OR gate 494, the output of exclusive OR gate 494 providing the second input to AND gate 470 via terminal 472. Under these conditions, AND gate 470 is enabled and allows data to pass therethrough from terminal 468 to terminal 474.

Conversely, in the presence of a logic 1 pulse (corresponding to a note being played and directed to the tuned percussion) which appears at the output 466 of OR gate 464 following a load "L" pulse appearing at the output of buffer 478, the following sequence occurs. Flip-flop 430 is set in response to said logic pulse appearing at terminal 476. During the next successive data transfer, a logic 1 appearing at the "Q1" output 431 of flip-flop 430 is clocked into flip-flop 432 via its "D" input 433. The same load pulse now resets flip-flop 430. The "Q2" output of flip-flop 432 is now at logic 1 and applies an enabling signal to gate 442 which causes the flow frequency oscillator 440 comprising gate 442, inverter 444 and related circuit elements to output low speed oscillations, beginning with a positive going transition. Each such successive positive going transition of these oscillations, which are applied to "T" (toggle) input 496 of flip-flop 434, cause the flip-flop 434 to toggle.

Simultaneously with the enabling of gate 442, the "$\overline{Q2}$" output 498 of flip-flop 432 switches back to a logic 0 state thereby removing the set signal applied to flip-flop 436 set input terminal 484 and the reset signal applied to terminal 488 of flip-flop 434. It should be noted that the reset signal initially outputted by delay element 486 does not terminate until after the inverter 444 has outputted its initial positive going transition, this is turn assurring that the flip-flop 434 will not toggle out of its initial reset state until completion of one full cycle of the low speed oscillator 440.

At the completion of the first full cycle of the low speed oscillator 440, a period which allows several additional transmission sequences with their corresponding load "L" pulses to occur, flip-flop 434 toggles to produce a logic 1 signal at its output terminal 498. This logic 1 signal is applied to the reset terminal 500 of flip-flop 436 causing same to generate a logic 0 signal at its "Q4" output terminal 502 to remove the set signal from the set input terminal 504 of flip-flop 438. This allows flip-flop 438 to toggle or change states at one half the frequency of the master clock in response to each positive going transition appearing at the output of buffer 480.

Following this sequence of events, the very next load pulse is coupled to the reset input 506 of flip-flop 438 such that flip-flop 438 begins this and all subsequent transmission sequences in a logic 0 state, that is, it will output a logic 0 during odd ones of the clock cycles and a logic 1 during the even ones of the clock cycles. Since flip-flop 434 outputs a logic 1 at terminal 498 during this first of all subsequent load pulses, the toggling output of flip-flop 438 causes exclusive OR gate 494 to inhibit gate 470 during even numbered clock cycles until several sequences later. At this time, the low speed oscillator completes its second full cycle causing flip-flop 434 to toggle back to a logic 0 output at its terminal 498. This in turn causes exclusive OR gate 494, as regards its processing of the flip-flop 438 output signal, to change from an inverting to a non-inverting function, causing gate 470 to be inhibited during odd numbered clock cycles, and enabled during even numbered clock cycles. This toggling of flip-flop 434 continues until the manual key is released at which time the entire circuit returns to its initialized conditions. It will thus be observed, that the circuit produces an intermittent transmission of alternately interposed logic bits of the keyed data to the related percussion device to effect alternately interposed note reiteration. It will further be observed that this does not occur immediately on depression of the key but does occur shortly thereafter, thereby assurring immediate key response without any loss in the subsequent reiteration function.

It should be noted that the speed of reiteration for the entire instrument thus controlled may be adjusted via a single control, specifically variable resistor 448 which determines the frequency of low-speed oscillator 440.

The time relationship of the various signals of FIG. 8 is illustrated figuratively in FIG. 9, and in particular the relationship of the load signals "L" and the outputs, denoted as "Q1", "Q2", "Q3", "Q4", and "Q5" occurring in the reiteration circuit 172 and appearing at the like labeled terminals of the flip-flops of FIG. 8. The shaded portions in the load "L" signal, the "Q1" signal, and the "Q5" signal indicate an indeterminate number of load "L" pulses which occur at the beginning of the period in which the activating key is held depressed, a similar, but corresponding indeterminate number of "Q1" transitions from a logic 0 to a logic 1 back to a logic 0 in response to the occurrence of data signals and a subsequent load pulse, and an indeterminate number of half-frequency clock cycles between the first Q3 transition and the next load "L" pulse, respectively.

Figure 10:
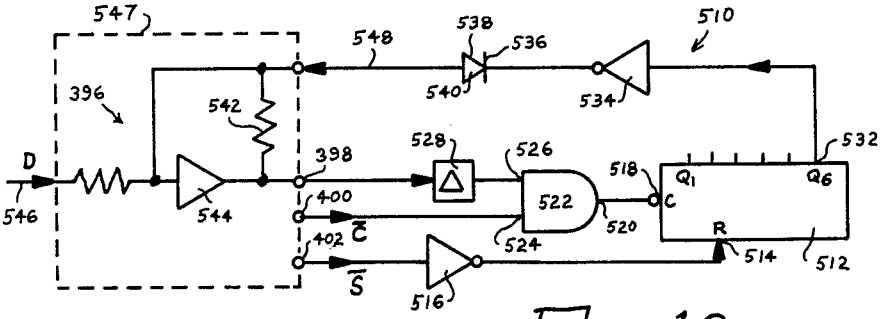
FIG. 10 is a circuit diagram of a note limiter circuit for use in the present invention.

Referring now to FIG. 10, there is illustrated a rank note limiter circuit, indicated generally as 510, this circuit not having been shown in FIG. 1. This circuit which may be connected to any rank driver 160 through 168, limits the maximum number of notes which may be activated simultaneously in any rank. The circuit is provided to prevent circuit overload due to careless musianship, or in the event of a system malfunction which might occur and result in a data line being locked in a static logic 1 condition. In this circumstance, the notes normally responsive to a particular driver affected by such malfunction could all sound at once. The rank note limiter eliminates this possibility and prevents overtaxing of the electrical and pneumatic power supplies of the organ.

The outlined circuitry 47 shown in FIG. 10 represents a portion of the rank driver of FIG. 7, specifically noninverting buffer 544 and its positive-feedback resistor 542, the combination of which basically comprises the particular one of Schmitt triggers 396 (FIG. 7) which outputs the conditioned data "D" signal on its terminal 398. Also shown in FIG. 10 are output terminals 400, 402 of the similar signal-conditioning apparatus of FIG. 7 which terminals output conditioned inverted clock "$\overline{C}$" and conditioned inverted sync "$\overline{S}$" signals, respectively. Further depicted in FIG. 10 are the connections of the limiter circuit, indicated generally at 510.

Basically, the limiter comprises a binary counter 512 having a reset input terminal 514 connected to receive a sync "S" signal from the output of inverter 516 whose function is to reinvert the conditioned inverted sync, "$\overline{S}$" signal appearing at terminal 402. Binary counter 512 also has a clock input terminal 518 connected to the output of AND gate 522, one of whose inputs, 524, is connected to receive the conditioned inverse clock signal "$\overline{C}$" from terminal 400 of circuitry 547 and the other of whose inputs, 526, is connected through a delay element 528 to recieve the conditioned data signal appearing at terminal 398 of circuitry 547. The "Q6" output terminal 532 of binary counter 512 is connected through an inverter 534 to the cathode 536 of a diode 538. The anode 540 of said diode is connected via wire 548 to the input of noninverting buffer 544 so as to enable a logic 0 being outputted from inverter 534 to override any logic 1 signals normally inputted by buffer 544, and thus to force a steady logic 0 state at output terminal 398.

In operation, within any particular transmission sequence AND gate 522 will normally output a logic 1 during the second half of each clock cycle during which a logic 1 is being received via data line 546. At the completion of each such clock cycle, AND gate 522 outputs a negative-going transition which increments binary counter 512. If the counter receives 32 such clocking signals within any particular data transmission, i.e., between successive sync. pulses "S", the "Q6" output 532 thereof will assume a logic 1 state in response to the negative-going edge of the 32nd pulse. This will cause inverter 534 to force, through diode 538, a logic 0 on conductor 548. Within the rank driver itself, there is provided a Schmitt trigger comprising buffer 544 and associated elements, which is connected to receive the signal on line 548. The logic 0 signals thus forced on this line, prevent the Schmitt trigger from outputting any additional logic 1's. This also prevents any further clock pulses from being applied to the binary counter 512.

Thus, it is seen that the circuit effectively "latches up" or blocks the data processing portion of a driver to which it is connected until the next sync. pulse is received to reset the counter 512 and restore the circuit to its original condition. Delay element 528 is provided to prevent false clocking of the counter 512 by a logic 1 signal arriving on the data line 548 before a logic 0 arrives on the inverse clock input 524 of AND gate 522. This circuit is seen to limit the number of notes played on any particular rank to a maximum of 32 during any individual data sequence. The actual number limit can of course be varied by utilizing different output terminals of the binary counter 512 and through the use of suitable AND gates such as desired. The limit embodied in the present invention is set at 32 as being a reasonable maximum number of notes that would be played for a particular rank of organ pipes during any normal or even abnormal musical rendition.

Figure 11:
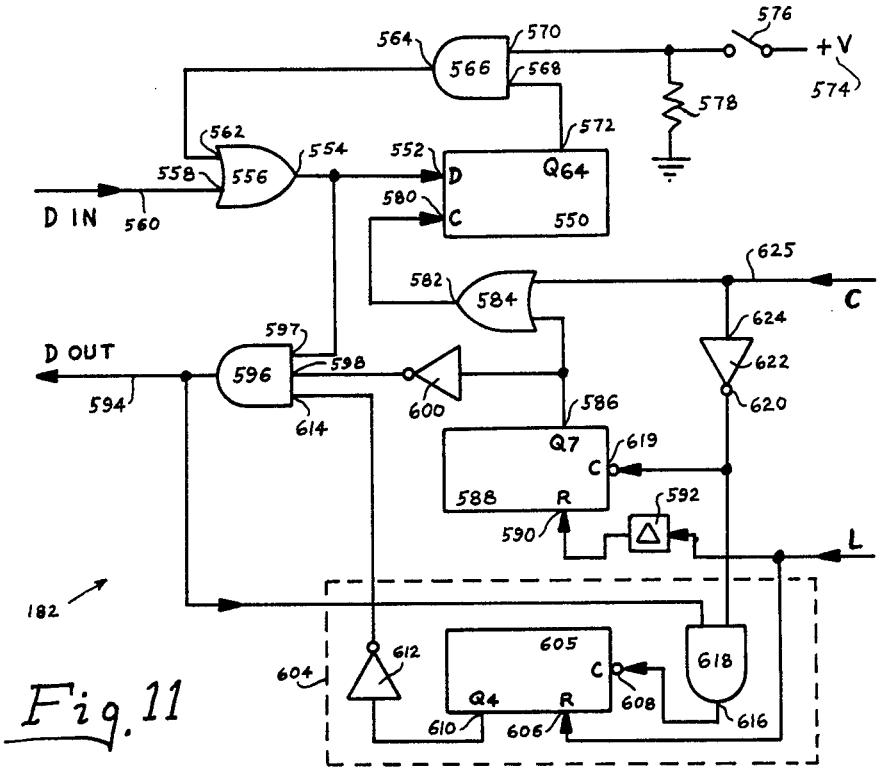
FIG. 11 is a circuit diagram of a sostenuto circuit for use in the present invention.

Referring now to FIG. 11, there is illustrated the logical circuitry of the sostenuto control circuit 182 (FIG. 1) and indicated generally as circuit 182 in FIG. 11. The primary element of the sostenuto control circuit 182 is a 64-stage shift register 550 having a data input terminal 552 connected to the output terminal 554 of OR gate 556, OR gate 556 having one input terminal 558 thereof connected to a data input line 560 to receive the serialized data signal directly from a selected input register such as registers 106 through 116 (FIG. 1). The other input 562 of OR gate 556 is connected to the output terminal 564 of AND gate 566 whose inputs 568, 570 are connected to the "Q64" output terminal 572 of shift register 550 and to a positive voltage (logic 1) source 574 via sostenuto control switch 576, a pulldown resistor 578 being connected to provide a logic 0 at terminal 570 whenever switch contacts 576 are open.

It will be observed that when switch 576 is closed, AND gate 566 is enabled whereby signals emanating from output terminal 572 of shift register 550 will be passed to input terminal 562 of OR gate 556, and thereby permitted to circulate from output terminal 572 back into input terminal 552 of the register 550 in response to master clock "C" pulses passed from terminal 221 of the master oscillator (FIG. 2) via conductor 625 to a clock input terminal 580 of register 550 through OR gate 584. Thus, data can be entered into shift register 550 via OR gate 556 either directly from the data input conductor 560 or from the output "Q64" terminal 572 to recirculate data through the shift register 550. This in turn provides a means for repeating a particular data bit pattern when the data bit pattern itself otherwise terminates. It will be recalled that each data transmission in fact includes 109 data bits while the shift register 550 only has a capacity of 64 bits. In fact, however, only 61 data bits are originated from any particular manual (each manual having a maximum of 61 keys) with the additional data bits of the sequence being necessary to permit full control of one or more ranks of organ pipes which may extend to a maximum of 109 notes.

Thus, it will now be apparent that the circuit must pause during that portion of the serial data signal which extends between the 65th and 109th clock pulse. To this end, the clock input signal to terminal 580 of register 550 is received from the output 582 of OR gate 584, as previously noted. The input signals to OR gate 584 are received from the "Q7" output terminal 586 of a binary counter 588 and directly from the clock output terminal 221 of master oscillator 186 (FIG. 2) via conductor 625. Binary counter 588 is assumed to have a logic 1 appearing at its output terminal 586 thereby inhibiting OR gate 584 just prior to the beginning of a data transmission. The reset terminal 590 of binary counter 588 is connected to receive a load "L" pulse from terminal 222 of the master oscillator (FIG. 2) via delay element 592. A clock terminal 619 of binary counter 588 is connected to receive signals from the output 620 of inverter 622 whose input 624 receives clock signals from conductor 625 such that binary counter 588 increments in response to positive-going transitions occurring on conductor 625. Delay element 592 is provided to give the clock signal "C" ample time to execute its positive-going transition coincident with the beginning of the load pulse and thus maintain gate 584 inhibited before the logic 1 signal appearing at output terminal 586 of counter 588 disappears in response to a prematurely-received load signal "L".

During the second half of the first complete clock cycle, OR gate 584 outputs a logic 0 to the clock input terminal 580 of register 550 whereby, at the end of the first logic 0 pulse thus applied to the clock input terminal 580 (which is concurrent with the end of the first complete clock cycle) the data outputted by OR gate 556 is clocked into the first stage of shift register 550, which continues to shift in data in this manner during the next 63 clock cycles. Simultaneously, binary counter 588 is responsive to each positive-going clock transition following a load "L" pulse, such that at the end of the 64th clock cycle the "Q7" output appearing at terminal 586 becomes a logic 1. This prevents further shifting of data into shift register 550 and this condition continues from the 65th through the 109th clock cycles. At the same time, all of the data that has been shifted into shift register 550 remains static, that is, in the same state that it was immediately prior to interruption of the clock pulses applied to clock terminal 580. It will thus be seen that the 61 binary data bits queued up within register 550 in its fourth through 64th stages correspond exactly to the manual entry data and are ready to be recirculated upon the beginning of the next data transmission. However, it will be noted that the output 572 of register 550, and hence the logic state appearing at terminal 554 of OR gate 556, may be a logic 1 is the bottom note of the particular keyboard has been actuated. Correspondingly, this logic 1 would be interpreted as 45 individual logic 1 data bits if it were to be routed directly to the data "D" output terminal 594 of circuit 182 during the 65th through 109th clock cycles. Therefore, the data signal is passed from output 554 of OR gate 556 to an input 597 of AND gate 596 which has another input terminal 598 coupled through an inverter 600 to the "Q7" previously noted, be a logic 1 during the 65th through the 109th clock cycles. In response to this logic 1, a logic 0 is applied to AND gate 596 and AND gate 596, from whose output is extracted the data output of circuit 182 along conductor 594, acts as a suitable blocking device. This in turn prevents the output of logic 1 note signals therefrom and thence to a corresponding pitch register.

Additionally, circuit 182 is provided with a limiting circuit 604. Circuit 604 includes a binary counter 605 having reset input terminal 606, clock input terminal 608, and a "Q4" output terminal 610. Terminal 610 is connected through an inverter 612 to a third input terminal 614 of AND gate 596. Clock input terminal 608 of binary counter 605 is connected to the output of 616 of AND gate 618, the latter having its inputs connected to the data "D" output conductor 594 and the output terminal 620 of inverter 622, the latter having its input terminal 624 connected to receive the clock "C" signal. Reset terminal 606 of binary counter 605 is connected to receive load "L" pulses directly from the master oscillator of FIG. 2. This circuit functions in a manner similar to that of the note limiter disclosed in FIG. 10 and is adapted to prevent logic 1 data bits in excess of the first eight such logic 1 data bits from passing from the data input conductor 560 (or from the output 572 of shift register 550) to the output conductor 594. This in turn can be seen to prevent such things as a full-keyboard glissando from being sustained by this circuit.

In operation, the sostenuto control will respond to closure of switch 576, this switch being manually controlled by the organist at the organ console. When switch 576 is closed, the data bits, corresponding to notes momentarily depressed on the particular keyboard to whose input register circuit 182 is coupled, are recirculated periodically through shift register 550 to repeat the data bit pattern for the period during which switch 576 is maintained closed thereby creating the sostenuto effect. Notably, this effect is achieved utilizing only a 64 stage shift register when, in fact, each data transmission sequence includes 109 separate data bits, this being effected by the unique pause and inhibit circuit above disclosed. The circuit also includes protective circuitry in the form of a note limiter 604 to again prevent overloading of the pneumatic and electrical sources supplying energy to the organ being controlled hereby.

Figure 12:
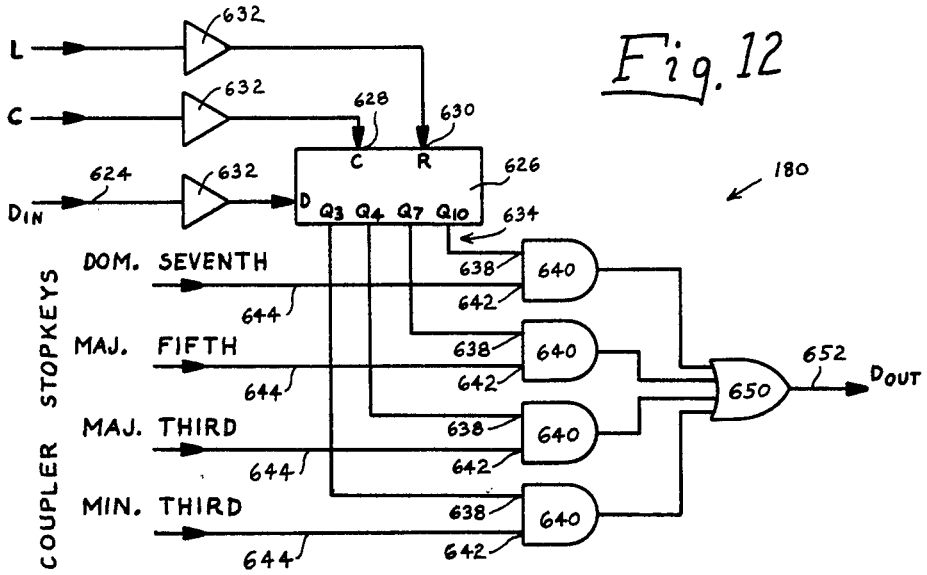
FIG. 12 is a logic diagram illustrating the operation of a mutation pitch coupler for use in the present invention.

Referring now to FIG. 12, there is illustrated the logical detail of a mutation coupler attachment such as mutation coupler 180 shown in FIG. 1. The mutation coupler, denoted generally at 180, provides means for coupling manual or pedal registrations at mutation pitches, that is, pitches other than octave intervals. The mutation coupler circuit includes shift register 626 which inputs serial data directly from an input register, but which is otherwise identical in operation to registers 300, 286, and 288 (FIG. 5). A plurality of parallel output terminals 634 of register 626 are connected to one of two input terminals 638 of each of a plurality of AND gates 640 whose outputs connect to the inputs of OR gate 650. The remaining one of the inputs, 642, of each of AND gates 640 are connected to mutation coupler stop key switches (not shown) through the same type of resistive networks (not shown) used extensively elsewhere in the present invention for mechanical switch interfacing. Thus configured, the combination of AND gates 640 and OR gate 650 comprises a circuit whose operation is identical to that of combiner 360 (FIG. 6). Parallel output terminals from the third, fourth, seventh, and tenth stages of register 626 may be connected, as shown in FIG. 12, to pitch input terminals 68 of ANd gates 640 to provide, upon activation of the corresponding coupler inputs 642, minor third, major third, major fifth, and dominant seventh musical transpositions of the serialized manual data, respectively, in any combination thereof, which combination of data signals is outputted by output terminal 652 of OR gate 650. Other musical mutation pitches may obviously be coupled thusly by utilizing others of the parallel outputs of register 626. The output signals appearing at conductor 652 are then coupled, for example, to an 8 foot coupler pitch input such as 309 (FIG. 5) of the particular pitch register whose corresponding manual registration is desired to be coupled, at mutation pitches, to the manual whose input register is connected to transmit data to this particular mutation coupler circuit. Inasmuch as register 300 (FIG. 5) is intended to transpose the musical pitch of notes represented by a serialized signal up one octave by shifting the signal through the 12 stages of the register and thus delaying each data bit by 12 clock cycles, the function of mutation coupler circuit 180 is thus philosophically identical, but utilizes different numbers of clock cycles to implement corresponding pitch transpositions other than the twelve utilized to achieve the even octave interval.

Figure 13:
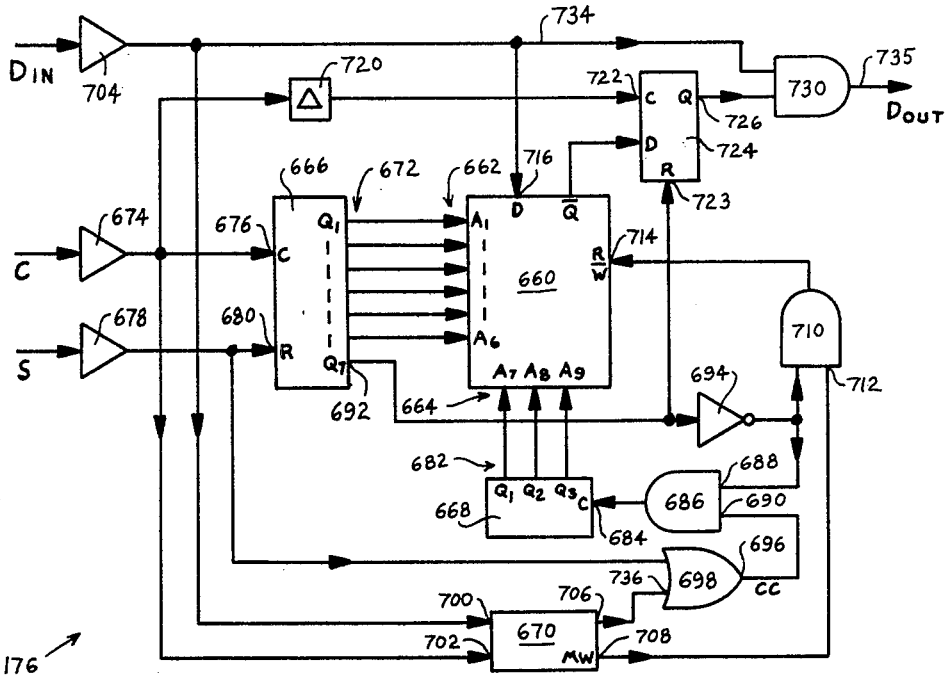
FIG. 13 is a logic diagram illustrating the operation of the pizzicato circuit for use in the present invention.

Referring now to FIG. 13, there is shown the logical circuitry for effecting pizzicato which can be incorporated into the system 10 as a coupler means or a pitch output. The pizzicato circuit is denoted generally as 176 and includes a "1 by 512" bit random access memory 660 which is addressed via two sets of binary address input terminals 662, 664. The address signals are generated by binary counters 666, 668, respectively, which may be, for convenience, referred to as the "row" and "column" address counters, respectively. Each of the eight columns thus configured will include 64 bits with 61 of these being associated with corresponding notes of a particular manual. The basic purpose of memory 660 is to keep track of, or record the status of each of the manual notes independantly for a period of time corresponding to eight consecutive transmission sequences (about 80 milliseconds). If a particular manual key is depressed, and the pizzicato circuit 176 is activated, the pizzicato circuit 176 will, after a predetermined number of serial data transmissions, inhibit the data bit corresponding to that note in the data stream for all subsequent data transmissions until such time as the key is released. The effectiveness of circuit 176 requires the ability to reset all the internal memory cells of memory 660 corresponding to a particular note within the same data sequence during which release of the note is detected. This function is provided by a resetting means 670 to be described below.

The individual memory cells within any selected column are addressed by the six lowest order outputs 672 of binary counter 666, counter 666 being connected to receive the clock "C" pulses via buffer 674 at its clock input terminal 676. Counter 666 responds to each positive going transition of buffered clock "C" signal. It will thus be noted that the note address of the memory is changed concurrently with each possible change of note data. The sync. signal "S" is inputted to counter 666 through buffer 678 via its reset input terminal 680, this signal resetting the binary counter to its lowest order note address at the end of each serial data signal thus initializing counter 666 to begin another sequence.

Similarly, the three lowest order output terinals 682 of counter 668 are used to address selected ones of the eight memory columns via column address terminals 664. A column counting signal is inputted to counter 668 via its clock input terminal 684, said signal being received from the output of AND gate 686. The input terminals 668, 690 of AND gate 686 are connected, respectively, to receive the seventh stage "Q7" output 692 of counter 666 through an inverter 694 and the buffered sync. signal "S" from buffer 678 from the output terminal 696 of OR gate 698, through whose secondary input terminal 736 additional signals, having the same effect as the sync. signal "S", may be inputted. Thus connected, AND gate 686 is inhibited during the final 45 clock cycles of each data transmission sequence. Upon the occurrence of a sync. signal "S" at the end of each sequence, counter 666 is reset, causing AND gate 686 to be enabled. Simultaneously, the sync. pulse "S" is transmitted through OR gate 698 to AND gate 686, this signal incrementing binary counter 668 to thereby address the next memory column to be processed during the following data transmission sequence. Normally, therefore, one would expect any particular memory column to be processed or sequentially addressed during every eighth data transmission sequence.

The resetting means 670 has input terminals 700, 702 connected to receive the buffered serial data input from buffer 704 and the buffered clock signal "C" from buffer 674, respectively. Resetting means 670 in response thereto, generates two output signals at its terminals 706, 708. Internally, the resetting means 670 will generate a burst of 16 logic 1 pulses. This burst of pulses is initiated immediately upon receipt of the positive-going transition of the clock signal "C" and terminates prior to a subsequent positive-going clock transition. Such a gated burst oscillator may be implemented in a number of ways obvious to those skilled in the art. The eight even numbered ones of these sixteen pulses are then separated out and transmitted from output terminal 708 to AND gate 710 input terminal 712. These signals, during the first 64 master clock cycles are allowed by AND gate 710 to pass into the "read/write" control input 714 of memory 660. Each of these pulses will place the memory 660 in a "write" state causing the particular memory cell that is currently being addressed to be set to the current logic state of the inputted data emanating from buffer 704 and being inputted into memory 660 via its data input terminal 716.

A delay element 720 is coupled between the clock buffer 674 and the clock input terminal 722 of a "D" type flip-flop 724. Delay element 720 is selected to provide a delay shorter than the time period which elapses between the beginning "positive transition" of a clock cycle and the appearance or start of the first one of the above-referenced even numbered pulses outputted from terminal 708 of resetting means 670. Flip-flop 724 has its "D" input terminal coupled to the "$\overline{Q}$" output of memory 660 to thereby receive the complement of the data contained in the currently addressed memory cell of the memory 660. Thus configured the complemented data is clocked into flip-flop 724 just after the addressing transients have settled out, but before new data can be written into the memory cell. It will be observed that the only conditions under which the data that is clocked into the flip-flop 724 can be a logic 0 is when a logic 1 has been written into all eight memory cells of the currently addressed note row during the previous eight data transmission sequences.

Flip-flop 724 will enter its logic 0 state, that is generate a logic 0 at its output terminal 726, for a particular note during a data transmission sequence when counter 668 selectes a column into which a logic 1 was initially written for that particular note eight data sequences earlier. Thus, this condition occurs when a particular note has been activated for eight consecutive serial data signal transmissions. Subsequently, the output appearing at output terminal 726 of flip-flop 724 shifts to a logic 0 and inhibits AND gate 730. The remaining input 732 of AND gate 730 is connected to the data transmission line 734 whereby, logic 1 note pulses normally appearing at output terminal 735 of AND gate 730 (which is also the main data output terminal of circuit 176) may be selectively inhibited by logic 0 signals being outputted by terminal 726 of flip-flop 724.

Turning again to the resetting means 670, the circuit also provides a secondary burst of eight logic 1 pulses which are synchronized to begin upon termination of each odd-numbered pulse of the internal 16-pulse burst, and hence just prior to each of the memory write pulses outputted on terminal 708. These eight pulses may appear at output terminal 706 of the resetting means 670 and are applied to the input terminal 736 of OR gate 698, but are gated internally to occur only if the current note data or signal sensed on input terminal 700 of the resetting means 670 is a logic 0 representative of a released or idle manual note. Thus, in response to each logic 0 data bit detected, the column select counter 668 is incremented eight times with eight write pulses being interposed therein, the combination of these signals resetting the entire row of memory cells addressed by counter 666 to logic 0. This all occurs during a single master clock cycle. Following the resetting operation, column select counter 668 is left in the same state in which it began thus avoiding any interference thereby with the timing of any other notes.

As with the sostenuto circuit described above, the pizzicato is seen to contain enough memory capacity to process only 64 notes (actually eight groups of 64 notes) and again it is therefore necessary to inhibit portions of the circuit from operation during the final 45 clock cycles of each serial data signal transmission sequence. This is accomplished by coupling the "Q7" output of counter 666, appearing at terminal 692, directly to the reset input 723 of flip-flop 724 which will force flip-flop 724 into a logic 0 output state. This thereby inhibits AND gate 730. This same signal is transmitted through inverter 694 to apply a logic 0 signal to AND gate 710, thereby inhibiting the memory write pulses from being transmitted to terminal 714 of memory 660. The same signal is further applied to input terminal 688 of AND gate 686 and similarly inhibits this gate to prevent the transmission of signals to the binary counter 668.

Thus, in operation, the pizzicato circuit 176 is basically a large memory device operating at a speed greater than the normal data transmission rate of the system 10. The memory device simply remembers when an individual note has been activated and thereby ascertains when that note has been maintained in an activated state for eight consecutive serial data signal transmission sequences. If the key is maintained depressed for a period longer than eight data transmission sequences, the pizzicato control inhibits the transmission of further data bits corresponding to that key through the system thereby providing the short duration pizzicato signal. As soon as a manual key to which pizzicato has been applied is released, the system returns to normal as regards that key and will repeat this operational sequence upon the next activation of that manual key.

Figure 14:
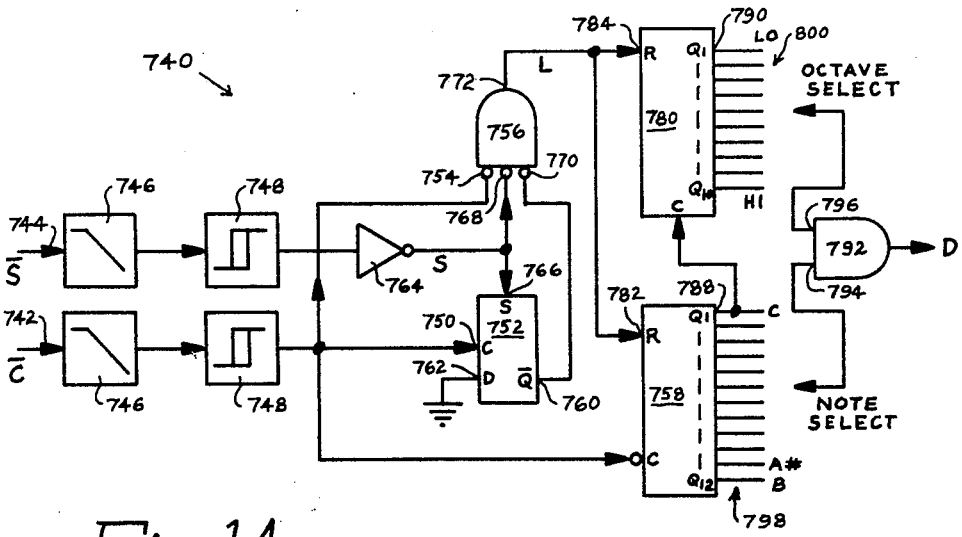
FIG. 14 is a logic diagram of an auxiliary tuning circuit for use in the present invention.

Referring now to FIG. 14, there is illustrated another of the auxiliary circuit for use with the present invention, this being a tuning circuit 740 which can be utilized for tuning the pipes of the organ first with respect to a reference tone and then with reference to each other. Normally selection and activation of the organ pipes for tuning purposes required two people, one person sitting at the organ console and the other in the pipe chambers. Verbal communication between these two people is often difficult due both to the distance between the console and the pipes and the sound generated by the pipes themselves while they are being tuned. Tuning circuit 740 on the other hand, can be utilized by a single technician, can be operated in the organ chambers, and dispenses with the requirement of a manned console.

Basically, circuit 740 generates a repetitive logic 1 data signal during the same clock cycle of each sequence, the particular clock cycle of the sequence being selectable. Other configurations are possible of course, but it is convenient to select a particular musical note and a particular octave and this is the configuration illustrated.

Since the $\overline{C}$ and $\overline{S}$ signals are utilized by the drivers, these signals are utilized to generate the necessary timing and are shown being inputted via input conductors 742, 744, respectively. Both signals are passed through low pass filters 746 and Schmitt triggers 748 to clean and condition the signals. The inverse clock signal $\overline{C}$ is inputted to the clock input terminal 750 of "D" type flip-flop 752. This same signal is applied to input 754 of a NOR gate 756 and the clock input terminal of a "modulo twelve" ring counter 758.

Counter 758 and flip-flop 752 are clocked alternately in response to negative-going and positive-going transitions, respectively, of the inverse clock signal "$\overline{C}$". At the midpoint of each of the first 108 clock cycles, flip-flop 752 is conditioned to generate a logic 1 at its output "$\overline{Q}$" terminal 760 by reason of its "D" input 762 being grounded. Midway through the 109th clock cycle, the sync. pulse "S" occurs, this signal being applied through inverter 764 to the set input terminal 766 of flip-flop 752 overriding the logic 0 which would otherwise be clocked in, and placing it in its set condition.

This same reinverted sync. signal "S" is applied to input terminal 768 of NOR gate 756 inhibiting same. The "$\overline{Q}$" output at terminal 760 of flip-flop 752 is coupled to the third input terminal 770 of NOR gate 756. While a logic 0 signal appears at these terminals during the final half of the 109th clock cycle, gate 756 remains inhibited by reason of the sync. pulse "S" applied to terminal 768 thereof. When the sync. pulse "S" terminates, NOR gate 756 will output a logic 1 at its output terminal 772 until midway through the first clock cycle. At this point of time, a logic 1 is again generated at terminal 760 of flip-flop 752 thereby, again, inhibiting gate 756 for the remainder of the 109 pulse sequence. The logic 1 pulse thus outputted by NOR gate 756 occurs simultaneously with the load signal "L", the load signal "L" occurring at various places in the system but not normally occurring at or being present in the pipe chambers. Thus, the signal generated by NOR gate 756 is in fact a resynthesized load signal "L". This load signal "L" is in turn used to reset both the "modulo twelve" counter 758 and a decoded decade counter 780 both of which have their reset terminals 782, 784, respectively, connected to output terminal 772 of NOR gate 756. The clock input terminal 786 of decade counter 780 is in turn connected to the "Q1" terminal 788 of "modulo twelve" counter 758 whereby counter 780 is incremented one count each time counter 758 returns to its initialized state, this in turn corresponds to musical note "C". It will thus be seen that there exist 120 possible combinations of output states from counter 758 and 780 of which only 109 are attainable. During the first clock cycle, each of these counters outputs a logic 1 from its respective "Q1" output terminal 788, 790 respectively. By providing an AND gate 792 having its input terminals 794, 796 selectively coupled to selected ones of the output terminals 798, 800 of counter 758, 780, including the "Q1" output terminals 788, 790, thereof by means such as suitable multiple position selector switches, AND gate 792 will in turn generate a logic 1 output signal corresponding to a particular note of a particular octave. It will be observed that additional AND gates and selector switches can be provided and connected in like manner to provide a plurality of single note data streams corresponding to a plurality of rank driver inputs. Thus configured, the circuit will generate an activating signal for any particular organ pipe or group of organ pipes causing same to speak. This entire circuit is relatively small and can be installed or manually connected to the rank drivers and will permit a technician to thereby selectively cause individual ones or groups of pipes in the organ chamber to speak to enable tuning thereof.

Referring again to FIG. 1, an additional circuit which can be incorporated in the present invention is an auxiliary visual effects circuit 184. Circuit 184, shown in block diagram form only, is similar to the trap line circuitry 284 (FIG. 5). Basically, circuit 184 includes an input terminal 804 coupled to the data conductor 805 coupling the "Percussion" rank driver 168 to the "Percussion" rank-stop combiner 156. As with the trap line circuit 284, incoming data is sensed via the set terminal of a flip-flop (not shown) whose output is clocked into a second flip-flop by the sync "S" signal to generate a static control signal in response to data on the percussion data line. Preferably, the control signal thus generated is transmitted by means of a diode (functioning as a peak detector) to a time delay circuit such as a simple RC circuit which provides a delay in the "turning off" of the circuit 184 after the termination of the data pulses. By appropriate selection of component parameters the circuit can be adapted, for example, to respond to data pulses almost instantaneously and to remain activated for several seconds following the termination of the last data pulse. A similar effect can be obtained with a retriggerable monostable multivibrator circuit.

The output terminal 806 of circuit 184 is in turn coupled to a power circuit which may be used to control spot lights, or other special effects devices associated with the particular tuned percussion or other sounding device. Thus, in operation, the circuit will, in response to data signals being sent to its particular device, such as for example a piano, marimba, or the like, automatically cause the flood lights or the like associated with that device to be illuminated. This provides a striking and unusual visual effect which operates in synchronism with playing of the music without the requirement of additional special controls and/or conductors extending between the console and the lights themselves.

In the above discussion, the system was described as utilizing a clock frequency of 11 khz. In practice, a frequency range of 9 khz. to 13 khz. is found to be practical and in fact provides a number of distinct advantages. Specifically, a clock frequency in this range provides updating signals for as many as 109 individual organ pipes (the maximum that may reasonably be expected) at a repetition rate that precludes any interruption or delay in operation of a pipe when it has been activated by a manual key.

On the other hand, higher frequencies such as a 50 khz. clock frequency provides an updating signal at a frequency that far exceeds the response time of the electro-mechaical and pneumatic components of the system. Further, these higher transmission frequencies may require shielded wire or twisted pairs to meet Federal Communications Commission interferrence requirements, a situation not typically encountered when utilizing a 9 to 13 khz. range of clock frequencies used in the present invention. Further, the higher frequency signals will require the use of line drivers, for any given length of transmission line, which are five times more powerful than the ones required to transmit a 9 to 13 khz. signal due to the increased effects of capacitance on the transmission lines at the higher frequencies. Further, the higher frequencies in a 50 khz. range will normally require special line terminations and impedance matching to eliminate the undesirable effects of underdamped line responses. Further, the use of low pass filters at the receiving ends of such transmission lines are much more effective at the lower frequencies for the attenuation of interferrence signals in a range above the clock frequency. Lastly, signals in a range of 9 khz. to 13 khz. are within the audible range of the human ear whereas signals of 50 khz. are not. Thus, the presence or absence of a signal in the 9 to 13 khz. range can be easily detected by means of a simple audio transducer as compared with the use of an oscilloscope or special logic probes required for higher frequency signals. Again, this facilitates testing, signal tracing, and other trouble shooting functions.

In summary, the present invention provides a fully electronic, solid state relay system for a pipe organ, the system employing unique circuitry for converting the specially, chromatically related information generated by organ manuals into time based chromatically related serial signals, transmitting the signals via serial time-division multiplexing techniques and reconverting the serialized signals into parallel or spacially related outputs. Simultaneously with converting one of the spacial dimensions of the pipe organ switching matrix into time, the system incorporates unique circuitry which performs time related functions such as pizzicato, reiteration, and the like, the circuits digitally performing these functions on the time based serialized signal. This in turn provides additional significant benefits in simplifing and improving the reliability of such a system. The system, further, by reason of substituting time for one of the spacial dimensions, enables simple and effective unification of the organ, the system substantially reducing the number of inter-connections that must be hand wired into the system. The serial multiplexing of the data permits the hand wiring between the console and organ pipes to be reduced from a complex and tediously connected maze to a few single, unshielded conductors. Specific frequencies utilized further enhance operation of the system by providing fast, inaudible updating of signals to the organ pipes without requiring expensive and sensitive high frequency circuitry.

While there have been described above the principles of this invention in connection with specific apparatus, it is to be clearly understood that this description is made only by way of example and not as a limitation to the scope of the invention.

What is claimed is:

1. For use in a pipe organ which includes at least one manual having a plurality of manually operable keys disposed in chromatic spacial relationship, a plurality of stop tabs, and at least one rank of organ pipes individually operable by chest magnets, an electronic control system comprising: master oscillator means for generating a clock signal of predetermined frequency and control signals having predetermined time relationships to said clock signal; at least one input register means having control terminals connected to said master oscillator means to receive said clock and control signals therefrom, a plurality of input terminals connected to said manual, and an output terminal, for receiving note signals in parallel from said keys in response to operation thereof and repetitively generating a serial data signal at said output terminal, said serial data signal including a plurality of binary data bits, there being one said data bit for each key of said manual, said bits disposed in a chromatic sequential relationship corresponding to the spacial chromatic relationship of said keys; at least one pitch register means connected to said master oscillator means to receive said clock and control signals therefrom, and to said input register means to receive said serial data signal, said pitch register means including a plurality of pitch output terminals and pitch generating means for generating a plurality of pitch output signals in response to said serial data, clock, and control signals, each of said pitch output signals appearing at a particular pitch output terminal and including the binary data bits of said serial data signal inputted to said pitch register means, and transposed in time relationship, and thereby in representative chromatic musical relationship with respect to said binary data bits of said serial data signal; at least one combiner means connected to receive predetermined ones of said pitch output signals and to said stop tabs to receive stop tab signals and being responsive thereto to generate a composite data signal including selected combinations of said predetermined pitch output signals; at least one rank driver means connected to receive said composite data signal and said clock and control signals from said combiner means and said master oscillator means, respectively, for generating in response thereto a plurality of periodically updated parallel output signals corresponding in spacial chromatic relationship to individual ones of said binary data bits of said composite data signal, said rank driver means including amplifier means for amplifying said parallel output signals for operating individual ones of said chest magnets in response thereto for actuating corresponding individual ones of said organ pipes.

2. The system of claim 1 wherein said organ includes a plurality of ranks of organ pipes, said ranks being operably responsive to a corresponding plurality of said rank driver means each connected to receive a train of said composite data signals from a corresponding plurality of said combiner means, each of combiner means being configured to receive a particular combination of said pitch output signals and stop tab signals from said pitch register means and said stop tabs, respectively, each of said ranks being responsive to selected combinations of said pitch output signals.

3. The system of claim 2 wherein one of said ranks includes a pneumatically operated percussive instrument.

4. The system of claim 2 wherein said organ includes a plurality of coupler tabs and wherein said pitch register means includes signal distribution means connected to receive said serial data signal from said input register means and to receive coupler tab signals from said coupler tabs for the selective distribution, in response to said coupler tab signals, of said serial data signal to a predetermined plurality of multiple-input signal injection means, said pitch generating means including a plurality of parallel-output shift registers, each of predetermined binary length and each having a serial input terminal and at least one output terminal, said shift registers being serially coupled by means of individual ones of said signal injection means, additional inputs of said signal injection means being selectively connected to receive said serial data signal from said signal distribution means, said pitch generating means being responsive thereto for outputting at each of said pitch outputs one or more data bits separated in time in response to each data bit of said serial data signal received by said signal distribution means, thereby providing intramanual coupling.

5. The system of claim 2 wherein said organ includes a plurality of said manuals, there being a corresponding plurality of said input register means and of said pitch register means, said plurality of combiner means each being connected to receive a particular combination of said pitch output signals from a particular combination of said plurality of pitch register means.

6. The system of claim 4 wherein said organ includes a plurality of said manuals, there being a corresponding plurality of said input register means and of said pitch register means, said plurality of combiner means each being connected to receive a particular combination of said pitch output signals from a particular combination of said plurality of pitch register means, additional inputs of said signal injection means of each of said pitch register means each being selectively coupled to receive a train of said serial data signals from signal distribution means of other different ones of said pitch register means normally associated with manuals and input register means not otherwise communicating with a particular pitch register means, thereby providing intermanual coupling.

7. The system of claim 1 wherein at least one of said ranks comprises a number of notes exceeding the maximum number of keys of said organ manual, the particular one of said rank driver means associated therewith being likewise extended in compass to correspond thereto, said pitch generating means including shift register means for delaying the time position of said binary bits of said pitch output signals by predetermined numbers of clock pulses with respect to the binary bits of said serial data signal, predetermined portions of said extended rank being thereby operative in response to predetermined ones of said pitch output signals.

8. The system of claim 4 wherein at least one of said ranks comprises a number of notes exceeding the maximum number of keys of said organ manual, the particular one of said rank driver means associated therewith being likewise extended in compass to correspond thereto, said pitch register means including said combination of said shift register means and said signal injection means for selectively delaying the time position of said binary bits of each of said pitch output signals generated thereby by predetermined numbers of clock pulses with respect to the binary bits of said serial data signal in response to the particular selection of said signal injection means conditioned to receive said serial data signal, predetermined portions of said extended rank being thereby operative in response to each of predetermined ones of said pitch output signals thus delayed.

9. The system of claim 4 wherein said pitch output terminals include terminals connected to receive signals from predetermined binary stages of said shift register means and terminals connected to receive signals from predetermined ones of said signal injection means at least one of said pitch output terminals being disposed to receive a particular binary data bit propagated along said shift register means sequentially prior to the receipt of said binary bit by at least one of said signal injection means to thereby prevent said pitch output terminal from responding to other signals received by said signal injection means thereby excluding the response of one or more of said pitch output signals to the operation of one or more of said coupler tabs.

10. The system of claim 7 wherein said input register means is structured to generate said serial data signal beginning with the binary bit representative of the lowest note of said organ manual, whereby the particular pitch output signals and coupler tabs affected by said exclusion are associated with the low extremeties of musical pitch.

11. The system of claim 1 wherein said combiner means includes a plurality of AND gates, each of said AND gates having one input terminal thereof connected to a predetermined different one of said stop tabs and another input terminal thereof connected to said pitch register means to receive a predetermined one of said pitch output signals, each of said AND gates being enabled by the corresponding one of said stop tab control signals, said combiner means further including an OR gate having a plurality of inputs individually connected to the outputs of said AND gates to receive said pitch output signals from enabled ones thereof, the output of said OR gate being said composite data signal.

12. The system of claim 1 wherein said rank driver means includes a plurality of shift registers associated with each said rank, each of said plurality of shift registers having a data input terminal connected to receive said composite data signal and including a plurality of output terminals individually connected through said amplifier means to said chest magnets of said rank, clock distributor means connected to said master oscillator means to receive said clock and control signals for generating a plurality of sequentially occurring distributed clock signals having a predetermined time relationship to said clock and control signals, each of said distributed clock signals comprising a number of pulses equal to the number of stages comprising corresponding ones of said registers, there being one said distributed clock signal generated for each said shift register, each said shift register being connected to said clock distributor means to receive a predetermined one of said distributed clock signals and being responsive thereto to serially receive predetermined groups of said binary data bits of said serial data signal and in the absence thereof to output said predetermined groups of said binary bits in parallel.

13. The system of claim 12 wherein predetermined groups of said parallel output signals are in a state of change in the presence of corresponding ones of said distributed clock signals and static in the absence thereof, the active states of said distributed clock signals having a time duration shorter than the response time of said chest magnets, the idle period between reoccurrence of any particular distributed clock signal being substantially greater than said active states, whereby, the operative state of said chest magnets corresponds to the static output signals of said shift registers only.

14. The system of claim 6 wherein said coupler tabs include at least one mutation coupler tab, said system further including mutation coupler means connected to said input register means to receive said serial data signal and to said master oscillator means to receive said clock and control signals for generating in response thereto at least one mutation coupler output signal, said mutation coupler output signal being said serial data signal digitally delayed in time by predetermined numbers of clock signal pulses other than integral multiples of 12, said mutation coupler means including combinational logic elements connected to receive said mutation coupler output signal and signals from said mutation coupler tabs for selectively directing said mutation coupler output signal to at least one mutation coupler output terminal in response to said mutation coupler tab signals, said mutation coupler output terminals being connected to predetermined ones of said signal injection means to selectively introduce said mutation coupler output signal thereinto.

15. The system of claim 14 wherein there are a plurality of said mutation coupler output signals each being selectively distributed by said combinational logic elements to said mutation coupler output terminals in response to said mutation coupler tab signals, said predetermined numbers of clock pulses including three, four, seven and 10.

16. The system of claim 2 further including reiteration means connected to said master oscillator means to receive said control signals, to predetermined ones of said pitch output terminals to receive said pitch output signals, and to predetermined ones of said stop tabs to receive said stop tab control signals, for selectively enabling the transmission of corresponding combinations of said pitch output signals to a gated output circuit, said reiteration means further including an interruption signal generating means for generating a gating signal, said gated output circuit being coupled to receive said gating signal, said gating signal occurring at a repetition rate less than that of said serial data signal, said gated output circuit alternately transmitting and blocking said combinations of pitch output signals at a predetermined interruption rate in response to the absence and presence of said gating signal, respectively, a terminal of at least one of said combiner means, otherwise connected to receive a pitch output signal directly, being connected to receive said interrupted combinations of pitch output signals from said gated output circuit, the corresponding stop tab signal input of said combiner means being permanently enabled.

17. The system of claim 16 wherein said interruption signal generating means includes oscillator means for generating an oscillator signal having a predetermined repetition period greater than the time period of a plurality of said serial data signals.

18. The system of claim 17 wherein said reiteration means further includes a time delay circuit connected to receive said combinations of pitch output signals and being responsive thereto for delaying operation of said interruption signal generating means for the period of a predetermined plurality of said serial data signals, whereby, said combination of pitch output signals will be initially transmitted by said gating circuit to thereby provide response of the particular rank responsive thereto immediately upon operation of said manual associated therewith.

19. The system of claim 18 wherein said reiteration means includes interposer means connected to said master oscillator to receive said clock and control signals therefrom and connected to said interruption signal generating means to receive said gating signal therefrom for generating an interposer signal synchronized to said clock signal and one-half the frequency thereof, said interposer signal being inverted with respect to its non-inverted form in response to the presence of said gating signal, said gated output circuit being connected to receive said interposer signal instead of said gating signal for alternately transmitting to said combiner means even and odd numbered data bits of said combination of pitch output signals in response to the presence and absence, respectively, of said gating signal, said interposer means being further responsive to said time delay circuit.

20. The system of claim 1 further including a rank note limiter circuit connected to said master oscillator means to receive said clock and control signals therefrom and connected to said rank driver means to receive said composite data signal from a buffer circuit included therein, said rank not limiter circuit including counting means responsive to a predetermined number of said serial data bits in a single said composite data signal for generating a disabling signal, said buffer circuit being disabled thereby when the number of said serial data bits in any said composite data signal exceeds said predetermined number, said rank driver means being responsive only to those of said serial data bits passing through said buffer circuit.

21. The system of claim 20 wherein said counting means includes a binary counter having its clock input terminal connected to receive said composite data signals gated by said clock signal to partition consecutively occurring data bits thereof, and having output circuit means for generating said disabling signal in response to said predetermined number of binary data bits, and a reset circuit means for resetting said binary counter in response to each occurrence of said control signal received from said master oscillator means.

22. The system of claim 1 wherein said organ further includes a manually operable sostenuto control for generating a sostenuto control signal and further including a sostenuto circuit connected between a said input register means and said corresponding pitch register means, said sostenuto circuit including recirculating shift register means connected to receive said serial data signal and periodically repeat same in response to said sostenuto control signal, sostenuto mixing means connected to receive said serial data signal and said repeated serial data signal for combining same, to thereby repeat said serial data signal for the period of time during which said sostenuto control signal is received, said sostenuto circuit being also coupled to receive said clock and control signals frm said master oscillator means for synchronizing said sostenuto circuit.

23. The system of claim 22 wherein the number of binary data bits in said serial data signal exceeds the number of keys of any said manual, said sostenuto circuit further including a sostenuto delay circuit for delaying repetition of said serial data signal by said recirculating shift register means by a number of clock pulses equal to the difference in number of said manual keys and said binary data bits in said serial data signal in synchronism with the occurrence of those predetermined ones of said serial data bits in said predetermined positions in said serial data signal other than bit positions thereof corresponding to said manual keys.

24. The system of claim 22 further including sostenuto limiting means coupled to receive said clock and control signals from said master oscillator means, coupled to the output of said sostenuto mixing means to receive said combined sostenuto signals, and coupled to a control input of said mixing means for inhibiting said output of said mixing means in response to a sostenuto limiting signal, said sostenuto limiting means generating said limiting signal during the latter portion of any said serial data signal following the receipt thereby of a predetermined number of binary data bits of said combined sostenuto signal representative of notes manually operated and repeated by said sostenuto circuit.

25. The system of claim 24 wherein said input register means generates said serial data signal beginning with the binary bit representative of the lowest note of said organ manual, said predetermined number of binary data bits of said combined sostenuto signal being representative of notes lower in musical pitch than those additional notes represented by others of said data bits inhibited in response to said limiting signal.

26. The system of claim 6 further including a pizzicato circuit responsive to predetermined ones of said trains of serial data signals, said pizzicato circuit including a random-access memory having a multi-bit memory element for each said key of that one of said manuals with which said pizzicato circuit is associated, addressing means operable in response to said clock and control signals received from said master oscillator means for sequentially addressing an individual bit position of each memory element of said memory in synchronism with the occurrence of that one of said binary data bits corresponding to that one of said manual keys with which said memory element is associated, said memory elements having a predetermined binary bit capacity for remembering the logical state of each of said binary data bits for a predetermined plurality of consecutive serial data signals, output circuit means coupled to said random access memory for generating a pizzicato control signal when the contents of each said memory element correspond to activation of said corresponding key for said predetermined plurality of consecutive serial data signals, resetting circuit means coupled to receive said serial data signals for generating resetting signals to initialize the contents of each said memory element when the key associated therewith is released to a nonactivated state, and gating circuit means coupled to receive said serial data signal and said pizzicato control signals, said gating circuit means passing the binary data bits of said serial data signal in the absence of said pizzicato control signal and blocking individual ones of said binary data bits in the presence of said pizzicato control to generate a pizzicato data signal.

27. The system of claim 26 wherein at least one of said plurality of combiner means is coupled to said pizzicato gating circuit means to receive said pizzicato data signal therefrom, whereby said pizzicato data signal is selectively included in the corresponding ones of said composite data signals in response to the operation of corresponding ones of said stop tabs.

28. The system of claim 26 wherein a predetermined one of said signal injection means is coupled to said pizzicato gating circuit means to receive a said pizzicato data signal, said pizzicato circuit being coupled to predetermined output terminal of individual ones of said signal distribution means to selectively receive therefrom said trains of serial data signal in response to activation of corresponding ones of said coupler tabs.

29. The system of claim 26 wherein the number of said binary data bits in said serial data signal is greater than the number of keys of a said manual, the number of said memory elements in said random-access memory bing less than the number of said binary data bits, and further including pizzicato idling circuit means coupled to receive said clock and control signals from said master oscillator means and being responsive thereto to generate a pizzicato circuit idling signal during that portion of a said serial data signal including said binary data bits exceeding in number the elements in said memory, the pizzicato circuit being operative between an idle and an active state in response to the presence and absence of said pizzicato idling signal, respectively.

30. The system of claim 26 wherein said memory elements have a binary bit capacity equal to said predetermined number of consecutively occurring serial data signals, said memory elements being arranged in a matrix wherein each said memory element corresponds to a row in said matrix and each bit of said memory element corresponds to a column, said addressing means including row addressing counter means coupled to said master oscillator to receive said clock and control signals and being responsive thereto to generate binary coded output signals uniquely corresponding in value to the position of predetermined individual ones of said clock pulse occurring in each said serial data signal in synchronism with the occurrence thereof, and a column addressing counter means coupled to said master oscillator means to receive one of said control signals for generating a predetermined plurality of column address signals in succession in response to each said serial data signal, data writing circuitry coupled to receive said serial data signal for entering the binary value of each of said serial data bits into a predetermined bit position of said memory elements corresponding to the concurrently addressed row and column thereof, and output circuit means coupled to receive the binary contents of each of said particular bit positions concurrently with the occurrence of a binary data bit corresponding thereto, said output circuit means generating said pizzicato control signal when the contents of the addressed memory element all correspond to the activated state of the corresponding one of said keys, said column addressing counter means and said data writing circuitry including means connected to receive said resetting signals from said resetting circuit means for scanning and resetting individual ones of said memory elements corresponding to inactive keys during a single one of said clock pulse cycles.

31. The system of claim 1 further including a tuning circuit means selectively connectable to said rank driver means for repetitively generating a tuning signal, sid tuning signal including pluraity of sequentially occurring binary data bits corresponding in number and sequence to the said binary data bits of said composite data signal, said tuning circuit means further including manually operable selecting means for outputting a selected one of said binary data bits, said rank driver means, when connected thereto, being responsive to said selected one of said binary data bits of said tuning signal to activate a corresponding one of the pipes of said rank.

32. The system of claim 31 wherein said tuning signal generating means includes means coupled to said master oscillator for generating a repetitive tuning clock signal, first and second ring counters selectively connected in cascade, said first ring counter having a clock input terminal connected to receive said tuning clock signal and having a plurality of parallel output terminals, there being one said output terminal corresponding to each note of an octave, said second ring counter having an input terminal connected to a predetermined one of the output terminals of said first ring counter and having a plurality of parallel output terminals, there being one said last mentioned output terminal for each octave of said rank, tuning circuit reset means connected to said master oscillator to receive a predetermined one of said control signals and being responsive thereto for generating a tuning circuit reset signal for resetting said ring counters in synchronism with the occurrence of a predetermined one of said control signals, said selecting means including a tuning circuit output combinational logic element and first and second multiple position selector switches connecting a selected one of said first and second pluralities of output terminals to said tuning circuit combinational logic element, the output of said tuning circuit combinational logic element being active in response to the simultaneous occurrence of a selected individual combination of said note and said octave output signals, said last mentioned response occurring simultaneously with the occurrence of a corresponding binary data bit in said composite data signal associated with said note of said octave.

33. The system of claim 32 including a plurality of said selecting means for generating a plurality of trains of said selected tuning signals to thereby activate a corresponding plurality of notes to be tuned within a corresponding plurality of ranks.

34. The system of claim 33 further including a second selecting means comprising a second plurality of manually operable selector switches and a corresponding second plurality of combinational logic elements for selectively combining predetermined ones of said trains of selected tuning signals to generate a second plurality of selected tuning signals each including a plurality of said binary data bits for activating a corresponding plurality of said organ pipes within each of a plurality of said ranks.

35. The system of claim 1 wherein said master oscillator means predetermined frequency is in the audible frequency range.

36. The system of claim 35 wherein said frequency is between nine and thirteen kilohertz.

37. The system of claim 1 further including auxiliary lighting circuit means for generating a lighting control signal in response to said composite data signal in approximate synchronism with the initial response of said rank or tuned percussive device responsive thereto, said lighting circuit means including a lighting input circuit connected to receive said composite data signal, a time delay circuit connected to said lighting input circuit and being responsive to the absence of said binary data bits in a plurality of consecutive ones of said composite data signals for terminating said lighting control signal.

38. The system of claim 37 wherein said time delay circuit includes a capacitive discharge circuit having a predetermined time constant.

39. The system of claim 1 wherein said organ further includes at least one percussive trap device, and further including trap line circuit means having an input circuit connected to said input register means to receive a said serial data signal therefrom and an output circuit connected to a trap selection and control means, said trap line circuit means including a bistable circuit responsive to a predetermined one of said control signals received from said master oscillator means and to any said binary data bit in said serial data signal corresponding to an activated key of said manual for generating a static output signal substantially instantaneously in response to the occurrence of said binary data bits in subsequent ones of said serial data signals and to said predetermined one of said control signals for terminating said static output signal.

40. The system of claim 39 wherein said trap line circuit means includes at least one set-reset flip-flop circuit.

* * * * *